US012584258B2

(12) United States Patent
Seo et al.

(10) Patent No.: US 12,584,258 B2
(45) Date of Patent: Mar. 24, 2026

(54) LAUNDRY PROCESSING APPARATUS

(71) Applicant: LG Electronics Inc., Seoul (KR)

(72) Inventors: Junryung Seo, Seoul (KR); Sungjun Yun, Seoul (KR)

(73) Assignee: LG Electronics Inc., Seoul (KR)

( * ) Notice: Subject to any disclaimer, the term of this patent is extended or adjusted under 35 U.S.C. 154(b) by 84 days.

(21) Appl. No.: 18/554,335

(22) PCT Filed: Mar. 29, 2022

(86) PCT No.: PCT/KR2022/004401
§ 371 (c)(1),
(2) Date: Oct. 6, 2023

(87) PCT Pub. No.: WO2022/215930
PCT Pub. Date: Oct. 13, 2022

(65) Prior Publication Data

US 2024/0183096 A1 Jun. 6, 2024

(30) Foreign Application Priority Data

Apr. 6, 2021 (KR) ..... 10-2021-0044490

(51) Int. Cl.
*D06F 33/37* (2020.01)
*D06F 34/05* (2020.01)
(Continued)

(52) U.S. Cl.
CPC ..... *D06F 33/37* (2020.02); *D06F 34/05* (2020.02); *D06F 34/14* (2020.02); *D06F 39/022* (2013.01)

(58) Field of Classification Search
CPC ..... D06F 39/022; D06F 33/37; D06F 34/05; D06F 34/14
See application file for complete search history.

(56) References Cited

U.S. PATENT DOCUMENTS

2017/0016165 A1 1/2017 Favaro et al.
2017/0159221 A1 6/2017 Cho et al.
2019/0104911 A1 4/2019 Okubo et al.

FOREIGN PATENT DOCUMENTS

EP 3617380 A1 * 3/2020 ..... D06F 23/02
EP 3733949 A1 11/2020
(Continued)

OTHER PUBLICATIONS

Machine translation of KR-1577444-B1, dated Dec. 14, 2015. (Year: 2015).*
(Continued)

*Primary Examiner* — Michael E Barr
*Assistant Examiner* — Kevin G Lee
(74) *Attorney, Agent, or Firm* — Fish & Richardson P.C.

(57) ABSTRACT

A laundry processing apparatus is disclosed. A laundry processing apparatus according to an embodiment of the present invention comprises: a cabinet; a tub which is provided in the cabinet and in which water is received; a drum which is rotatably provided in the tub and in which clothes are received; a detergent supply device connected to the tub and including a first detergent container and a second detergent container in which a detergent supplied to the tub is stored; and a control part provided to control the detergent supply device and thus selectively perform a single detergent mode in which one of the first detergent container and the second detergent container supplies a detergent to the tub, and a complex detergent mode in which the first detergent container and the second detergent container together supply a detergent to the tub.

16 Claims, 16 Drawing Sheets

(51) Int. Cl.
*D06F 34/14* (2020.01)
*D06F 39/02* (2006.01)

(56) References Cited

FOREIGN PATENT DOCUMENTS

| | | | |
|---|---|---|---|
| JP | 2001-129292 | | 5/2001 |
| JP | 2020-523158 | | 8/2020 |
| KR | 10-2011-0004742 | A | 1/2011 |
| KR | 10-1577444 | | 12/2015 |
| KR | 10-2233307 | | 3/2021 |
| WO | 2011/134741 | A1 | 11/2011 |
| WO | WO 2013/187023 | | 12/2013 |

OTHER PUBLICATIONS

International Search Report and Written Opinion in Appln. No. PCT/KR2022/004401, mailed on Jul. 14, 2022, 18 pages (with English translation).
Partial Supplementary European Search Report in European Appln. No. 22784840.5, mailed on Feb. 25, 2025, 12 pages.
Office Action in Korean AppIn. No. 10-2021-0044490, mailed on Nov. 13, 2025, 13 pages (with English translation).

* cited by examiner

LAUNDRY PROCESSING APPARATUS

CROSS-REFERENCE TO RELATED APPLICATIONS

This application is a National Stage application under 35 U.S.C. § 371 of International Application No. PCT/KR2022/004401, filed on Mar. 29, 2022, which claims the benefit of Korean Application No. 10-2021-0044490, filed on Apr. 6, 2021. The disclosures of the prior applications are incorporated by reference in their entirety.

TECHNICAL FIELD

The present disclosure relates to a laundry treating apparatus, and more particularly, a laundry treating apparatus including a detergent feeder.

BACKGROUND

A laundry treating apparatus is an apparatus that performs various treatment processes on laundry, such as washing or drying the laundry, and includes a washing machine, a dryer, a refresher (a styler), and the like.

The laundry treating apparatus may be divided into a top loading scheme and a front loading scheme based on a scheme of putting the laundry into a drum, and may include a cabinet that forms an outer appearance thereof.

The washing machine that may perform a washing cycle of the laundry may remove contaminants from the laundry by putting the laundry, such as clothes and bedding, into the drum. The washing cycle of the laundry may include a washing process, a rinsing process, a dehydration process, a drying process, and the like.

The laundry treating apparatus that may perform the washing cycle of the laundry may include a tub accommodated inside the cabinet, the drum rotatably mounted inside the tub and accommodating the laundry therein, and a detergent feeder that feeds a detergent into the tub.

When the drum is rotated by a motor or the like while washing water is supplied to the laundry accommodated in the drum, the contaminants on the laundry may be removed by friction between the drum and the washing water.

The detergent feeder is equipped with a detergent feeding function to improve a washing effect. In this regard, the detergent refers to a substance that enhances the washing effect, such as fabric detergent, fabric softener, and fabric bleach. As the detergent, a detergent in a powder form or a detergent in a liquid form may be used.

In one example, Korean Patent Application Publication KR 10-2018-0090003 A1 discloses the detergent feeder included in the laundry treating apparatus. In the laundry treating apparatus, the washing of the laundry may be performed as the detergent stored in the detergent feeder is provided into the tub.

The detergent feeder may include a plurality of detergent containers in which the detergent is stored, and a user may store various detergents in the respective plurality of detergent containers and wash the laundry.

Accordingly, it is an important task in the present technical field to perform the washing cycle of the laundry by effectively using the various detergents stored in the plurality of detergent containers, and further to improve maintainability of the detergent containers in which the various detergents are stored.

SUMMARY

Technical Problem

Embodiments of the present disclosure are to provide a laundry treating apparatus that have a plurality of detergent storage spaces in which detergents are stored separately from each other in a detergent feeder to increase a storage capacity of detergents and store various detergents.

In addition, embodiments of the present disclosure are to provide a laundry treating apparatus that may perform an effective laundry washing cycle by utilizing detergents stored in a plurality of detergent storage spaces defined in a detergent feeder in an efficient scheme.

In addition, embodiments of the present disclosure are to provide a laundry treating apparatus that may improve a management performance by effectively improving maintainability of a detergent feeder in which various detergents may be stored.

In addition, embodiments of the present disclosure are to provide a laundry treating apparatus that may allow a user to conveniently identify and easily manipulate an operating state of a detergent feeder for a washing cycle of laundry.

Technical Solutions

A laundry treating apparatus according to one embodiment of the present disclosure may perform a washing cycle of laundry, and may have a plurality of detergent containers in which a detergent storage space in which a detergent is stored is defined.

For example, in one embodiment of the present disclosure, a detergent feeder may include a first detergent container and a second detergent container. The first detergent container and the second detergent container may be separated from each other and store the respective detergents therein independently of each other.

In the present disclosure, the detergent may include various types of detergents that may enhance a washing effect. For example, the detergent may include a laundry detergent to remove contaminants from the laundry, a softener to ensure flexibility of the laundry and protect fibers, a bleaching agent to decompose and remove colored substances penetrated the laundry, and the like, and may have various forms, such as a powder, solid, or liquid form.

In one embodiment of the present disclosure, a user may store the various types of detergents in the first detergent container and the second detergent container as needed. For example, the laundry detergent may be stored in each of the first detergent container and the second detergent container, or the laundry detergent may be stored in the first detergent container and the softener may be stored in the second detergent container.

In one example, one embodiment of the present disclosure may allow the user to efficiently set a supply scheme of the detergent. For example, the user may set a scheme of using only the detergent in the first detergent container, a scheme of using the detergents in the first detergent container and the second detergent container together, and the like.

In this regard, when the detergent stored in the first detergent container or the second detergent container is changed from the softener to the laundry detergent or from the laundry detergent to the softener, when the changed detergent is stored without cleaning the corresponding detergent container, the changed detergent may occur a chemical reaction with the existing detergent, which may cause coagulation of the detergents and generate foreign substances.

Gel-type foreign substances generated via the coagulation reactions between the detergents may accumulate or adhere to a path through which the detergent flows in the detergent feeder, impeding or blocking a flow of the detergent or water in the path.

In one embodiment of the present disclosure, when a detergent supply scheme of the detergent feeder is changed, the user may be requested to clean the detergent container via a notifier of the laundry treating apparatus or a user's communication terminal. The user's communication terminal may, for example, correspond to a mobile phone, and the user may be requested to clean the detergent container via a push notification via an application on the mobile phone.

Such laundry treating apparatus according to one embodiment of the present disclosure includes a cabinet, a tub, a drum, and a detergent feeder. The cabinet may form an outer appearance of the laundry treating apparatus, and the tub may be disposed inside the cabinet and accommodate water therein.

The drum is rotatably disposed inside the tub and accommodates laundry therein, and a detergent feeder is connected to the tub and includes a first detergent container and a second detergent container that store detergents supplied to the tub, respectively.

In one example, one embodiment of the present disclosure includes a controller that controls the detergent feeder to selectively perform a single detergent mode of supplying the detergent to the tub from one of the first detergent container and the second detergent container, and a complex detergent mode of supplying the detergents to the tub from the first detergent container and the second detergent container together.

The controller may select one of the single detergent mode and the complex detergent mode based on a manipulation signal input by a user via a manipulator disposed on the cabinet or a communication terminal portable by the user.

The single detergent mode may include a sequential detergent mode, and, in the sequential detergent mode, the controller may supply the detergent in the first detergent container to the tub when a remaining amount of the detergent in the first detergent container is equal to or greater than a reference amount, and supply the detergent in the second detergent container to the tub when the remaining amount of the detergent in the first detergent container is smaller than the reference amount.

The detergent feeder may include a remaining amount detector that detects remaining amounts of the detergents in the first detergent container and the second detergent container, and the controller may determine whether the remaining amount of the detergent in the first detergent container is equal to or greater than the reference amount based on a remaining amount detection signal of the remaining amount detector.

The controller may execute a detergent request mode of requesting a user to supply a detergent when a remaining amount of each of the detergents in the first detergent container and the second detergent container is smaller than the reference amount in the sequential detergent mode.

The controller may request the supply of the detergent by providing visual information or auditory information to the user via a notifier disposed on the cabinet or a communication terminal portable by the user in the detergent request mode.

The single detergent mode may further include a selected detergent mode, and the controller may control the detergent feeder to supply the detergent to the tub via one of the first detergent container and the second detergent container in the selected detergent mode.

The controller may select one of the sequential detergent mode and the selected detergent mode based on a manipulation signal input by a user via a manipulator disposed on the cabinet or a communication terminal portable by the user.

The controller may select one of the first detergent container and the second detergent container based on a manipulation signal input by a user via a manipulator disposed on the cabinet or a communication terminal portable by the user in the selected detergent mode.

The controller may execute a detergent request mode of requesting a user to supply a detergent when a remaining amount of the detergent in one of the first detergent container and the second detergent container is smaller than the reference amount in the selected detergent mode.

The controller may execute a cleaning request mode of requesting a user to clean the first detergent container or the second detergent container when a switch between the single detergent mode and the complex detergent mode occurs.

The controller may request the user to clean the first detergent container or the second detergent container by transmitting a cleaning request signal to a communication terminal portable by the user in the cleaning request mode.

The controller may end the cleaning request mode when receiving a cleaning completion signal input by the user via the communication terminal or a manipulator disposed on the cabinet in the cleaning request mode.

The first detergent container and the second detergent container may be constructed to be detachable from the detergent feeder, the detergent feeder may further include a detergent container detector that detects whether the first detergent container and the second detergent container are mounted, and the controller may end the cleaning request mode based on a detection signal of the detergent container detector in the cleaning request mode.

When receiving a cleaning progress signal input by the user via the communication terminal or a manipulator disposed on the cabinet in the cleaning request mode, the controller may end the cleaning request mode when it is determined that a current state is a cleaning completed state where the first detergent container or the second detergent container is cleaned.

When receiving the cleaning progress signal in the cleaning request mode, the controller may determine the cleaning completed state based on a cleaning completion signal input by the user via the manipulator or a detection signal of a detergent container detector that detects whether the first detergent container and the second detergent container are mounted in the detergent feeder.

The controller may end the cleaning request mode when receiving a forced shutdown signal input by the user via the manipulator in the cleaning request mode.

Advantageous Effects

The embodiments of the present disclosure may provide the laundry treating apparatus that have the plurality of detergent storage spaces in which the detergents are stored separately from each other in the detergent feeder to increase the storage capacity of the detergents and store the various detergents.

In addition, the embodiments of the present disclosure may provide the laundry treating apparatus that may perform the effective laundry washing cycle by utilizing the detergents stored in the plurality of detergent storage spaces defined in the detergent feeder in the efficient scheme.

In addition, the embodiments of the present disclosure may provide the laundry treating apparatus that may improve the management performance by effectively improving the maintainability of the detergent feeder in which the various detergents may be stored.

In addition, the embodiments of the present disclosure may provide the laundry treating apparatus that may allow the user to conveniently identify and easily manipulate the operating state of the detergent feeder for the washing cycle of the laundry.

DETAILED DESCRIPTION

Figure 1:
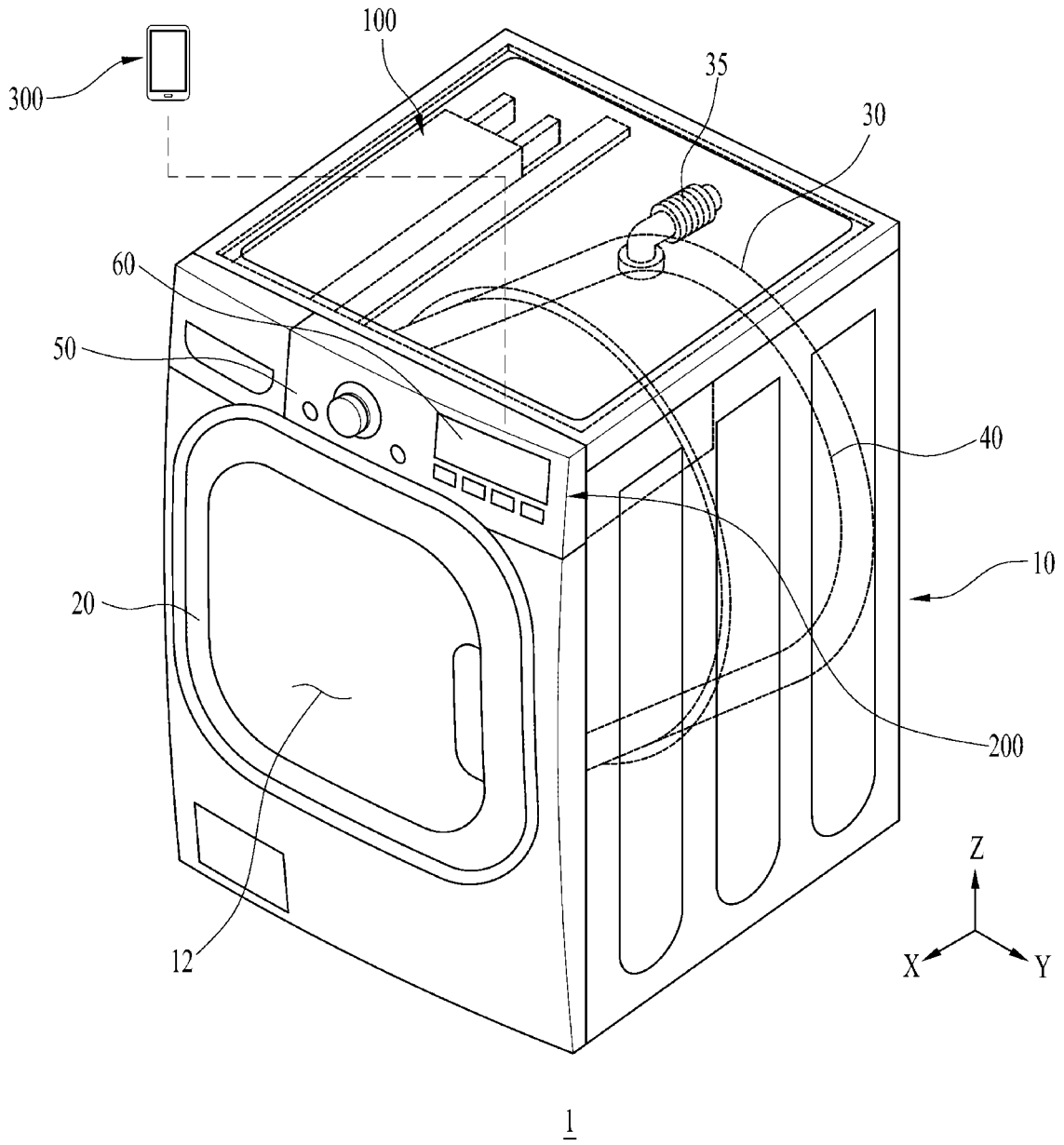
FIG. 1 is a perspective view showing a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

Figure 2:
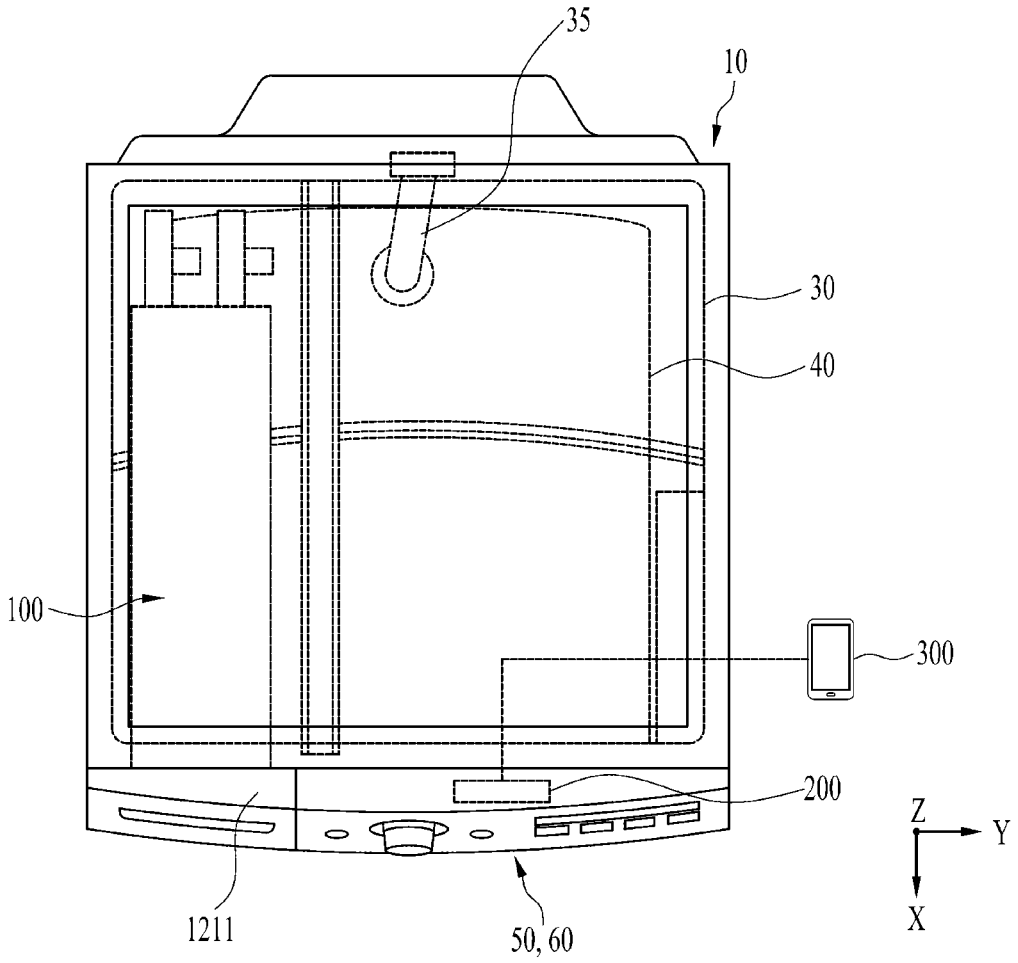
FIG. 2 is a top view showing a laundry treating apparatus according to an embodiment of the present disclosure.

FIG. 1 is a perspective view showing a laundry treating apparatus 1 according to an embodiment of the present disclosure, and FIG. 2 is a top view showing the laundry treating apparatus 1.

Referring to FIGS. 1 and 2, the laundry treating apparatus 1 according to one embodiment of the present disclosure includes a cabinet 10 forming an outer appearance of the laundry treating apparatus 1, a tub 30 installed inside the cabinet 10, a drum 40 rotatably installed inside the tub 30, and a detergent feeder 100.

The laundry treating apparatus 1 according to one embodiment of the present disclosure may perform a washing cycle of laundry to remove contaminants from the laundry. The washing cycle may include a water supply process, a washing process, a rinsing process, a dehydration process, a drying process, and the like.

The laundry treating apparatus 1 may be divided into a top loading scheme and a front loading scheme. FIG. 1 shows the laundry treating apparatus 1 in the front loading scheme, and this is only for convenience of description. The present disclosure is not applied only to the washing machine in the front loading scheme, so that the present disclosure may also be applied to the washing machine in the top loading scheme.

However, for convenience of description, one embodiment of the present disclosure will be described below as in a front loader type in which an inlet is defined in front surfaces of the tub 30 and the drum 40, as shown in FIGS. 1 and 2, and the laundry is able to be put into the apparatus via the inlet.

In one example, the cabinet 10 may form the outer appearance of the laundry treating apparatus 1. A space may be defined inside the cabinet 10, so that the tub 30, the drum 40, the detergent feeder 100, and the like may be installed in the cabinet 10. Various components for operating the laundry treating apparatus 1 may be disposed inside the cabinet 10.

The cabinet 10 may include a front plate, a rear plate, a top plate, a bottom plate, and a side plate. At least some of the plurality of plates may be molded integrally with each other, or may be manufactured separately and combined with each other to form the cabinet 10.

Referring to FIG. 1, a laundry inlet 15 may be defined in the front plate to allow the laundry to be introduced into the cabinet 10. The laundry inlet 15 may be in communication with the inside of the tub 30 and the drum 40.

A laundry door 20 may be installed on the front plate to open and close the laundry inlet 15. The laundry door 20 may be coupled to the front plate via a hinge portion or the like and be pivotable.

However, locations of the laundry inlet 15 and the laundry door 20 are not necessarily limited to the front plate. The laundry inlet 15 and the laundry door 20 may be located on the side plate, the rear plate, or the top plate as needed.

In one example, the tub 30 may be disposed inside the cabinet 10 and may be constructed to contain water therein. In one embodiment of the present disclosure, the tub 30 may be formed in a cylindrical shape with a front surface open.

A tub inlet defined in the front surface of the tub 30 may be defined to face the laundry inlet 15. Accordingly, the laundry introduced into the laundry treating apparatus 1 via the laundry inlet 15 may be accommodated inside the tub 30.

In one example, the drum 40 may be rotatably disposed inside the tub 30. The drum 40 may be formed in a cylindrical shape, and a drum inlet may be defined in a front surface thereof. The front surface of the drum 40 may be opened as a whole to define the drum inlet.

The drum inlet may be defined inside the tub 30 to face the tub inlet and the laundry inlet 15. Accordingly, the laundry that is introduced into the laundry treating apparatus 1 via the laundry inlet 15 may be accommodated inside the drum 40 via the tub inlet and the drum inlet.

In one embodiment of the present disclosure, water may be accommodated inside the tub 30, and a tub water supply pipe 35 for supplying water into the tub 30 may be disposed. The tub water supply pipe 35 may be connected to a water supply valve 140, which will be described later, or may be connected to the detergent feeder 100, so that water and/or a detergent may flow therethrough.

The drum 40 disposed inside the tub 30 may have a plurality of openings defined in an outer circumferential surface and/or a rear surface, and accordingly, water supplied into the tub 30 may flow into the drum 40. When water is discharged from the tub 30, water present inside the drum 40 may also be discharged to the outside of the tub 30.

The drum 40 may be rotatable about a rotation axis extending approximately in a front and rear direction. A driver for providing a rotational force to rotate the drum 40 may be coupled and fixed to the tub 30 or the cabinet 10. The driver may establish a coupling relationship with the drum 40 at the rear of the drum 40, or may be disposed on a circumference of the drum 40, for example, under the drum 40, and may establish the coupling relationship with the drum 40 via a belt or the like.

In one example, as described above, water may be stored inside the tub 30, and the laundry introduced into the cabinet 10 via the laundry inlet 15 of the cabinet 10 may be accommodated inside the drum 40. When the drum 40 rotates, an external force equivalent to a friction force with the drum 40 or the like may be applied while the laundry is soaked in water, so that the washing process of removing the contaminants may be performed.

In one example, one embodiment of the present disclosure may include a controller 200. The controller 200 may be disposed inside a control panel, which will be described later, or the cabinet 10. The controller 200 may have an electrical or signal connection relationship with a manipulator 50, a notifier 60, a communication terminal 300, and the driver, which will be described later, and various programs for the washing cycle of the laundry may be set.

FIGS. 1 and 2 schematically show that the control panel including at least some of the manipulator 50 and the notifier 60, which will be described later, is disposed on the front plate, and the controller 200 is built into the control panel.

However, the location of the controller 200 is not necessarily limited thereto. A plurality of controllers may be disposed as needed, or the controller 200 may be disposed inside the cabinet 10 and electrically connected or signal-connected to the control panel.

For example, in one embodiment of the present disclosure, a base for arranging various components on the bottom plate may be disposed, and the controller 200 may be disposed on the base.

In one example, one embodiment of the present disclosure may include the manipulator 50 and the notifier 60. FIG. 1 shows the manipulator 50 and the notifier 60 disposed on the front plate according to one embodiment of the present disclosure, but the manipulator 50 and the notifier 60 may be disposed at various locations, such as the top plate or the side plate.

The manipulator 50 may be disposed on the cabinet 10 so as to be manipulated by a user. The manipulator 50 may include various types of input devices that the user may manipulate.

For example, the manipulator 50 may include the input device such as a touch panel, a pressurized button, a dial button, and a microphone through which a user's touch signal may be input, the user may input a manipulation signal via the manipulator 50, and the manipulation signal may be transmitted to the controller 200 and may be reflected in various schemes for the washing cycle of the laundry.

The notifier 60 may be disposed on the cabinet 10 to provide information to the user. The notifier 60 may include various output devices to provide the information to the user.

For example, the notifier 60 may include a speaker for providing auditory information to the user, and a light emitter, a display, or the like for providing visual information to the user.

The controller 200 may transmit notification signals in various schemes, such as the visual information or the auditory information, to the user via the notifier 60, thereby providing various information related to an operating state of the laundry treating apparatus 1 or a drying cycle.

The manipulator 50 and the notifier 60 may be disposed inside the cabinet 10 or exposed to the outside of the cabinet 10. FIG. 1 shows the control panel including the manipulator 50 and the notifier 60 disposed on the front plate according to one embodiment of the present disclosure.

However, the locations of the manipulator 50 and the notifier 60 according to one embodiment of the present disclosure are not necessarily limited thereto. The manipulator 50 and the notifier 60 may be separated from each other and disposed independently of each other, or may be disposed at various locations, such as inside the cabinet 10 or on the top plate.

In one example, referring to FIGS. 1 and 2, in one embodiment of the present disclosure, the controller 200 may be signally connected to the communication terminal 300 portable by the user. The communication terminal 300 may be separated from the cabinet 10 and may be moved independently, may have a communication function, and may be carried by the user.

For example, the communication terminal 300 may correspond to a mobile phone that the user may carry. FIGS. 1 and 2 schematically represent the communication terminal 300 corresponding to the mobile phone.

However, in one embodiment of the present disclosure, the communication terminal 300 may not be necessarily limited thereto, and may be of various types capable of being in direct or indirect communication with the controller 200.

The controller 200 may be in communication with the communication terminal 300 using various schemes. In other words, the controller 200 may be signally connected to the communication terminal 300 using the various schemes.

For example, the controller 200 may be directly connected with the communication terminal 300 using various schemes that may exchange a wireless signal such as Wi-Fi, Bluetooth, and NFC, or may be indirectly connected therewith using intermediate means disposed inside or outside the laundry treating apparatus 1 and transmitting and receiving a communication signal.

For example, the controller 200 may be connected together with the communication terminal 300 to a Wi-Fi module disposed inside or outside the laundry treating apparatus 1, and transmit and receive a signal to and from the communication terminal 300 via the Wi-Fi module.

Alternatively, the controller 200 may be connected to the Wi-Fi module and transmit and receive the signal to and from a communication server corresponding to a terminal base station for communication of the communication terminal 300, thereby being signally connected to the communication terminal 300 via the communication server.

The communication scheme of the controller 200 described above is only an example to described one embodiment of the present disclosure, and the present disclosure is not limited to the above content. In one embodiment of the present disclosure, various schemes in which the controller 200 and the communication terminal 300 may directly or indirectly transmit and receive the signal with each other may be possible.

The user may manipulate the communication terminal 300 to input the manipulation signal, and the controller 200 may transmit the notification signal to the user via the communication terminal 300. That is, the communication terminal 300 may correspond to the manipulator 50 and the notifier 60 disposed on the laundry treating apparatus 1 according to one embodiment of the present disclosure.

One embodiment of the present disclosure may effectively improve a convenience of use of the laundry treating apparatus 1 by receiving the manipulation signal from the user or transmitting the notification signal to the user via the communication terminal 300 that is portable by the user as well as the manipulator 50 and the notifier 60 of the laundry treating apparatus 1.

In one example, FIGS. 1 and 2 schematically show the detergent feeder 100 built into the cabinet 10 in one embodiment of the present disclosure. One embodiment of the present disclosure may include the detergent feeder 100, and the detergent feeder 100 may be connected to the tub 30 to feed a detergent into the tub 30.

The detergent feeder 100 may include a detergent storage space where the detergent is stored, and the detergent stored in the detergent storage space may be supplied to the tub 30 in the washing cycle of the laundry to perform the washing cycle.

In the present disclosure, the detergent may be of various types and forms. For example, the detergent may include a laundry detergent to decompose and remove the contaminants from the laundry, a softener to improve flexibility of the laundry and protect fibers, a bleaching agent to decompose and remove colored substances that have penetrated the laundry, and the like.

The detergent may have various forms, such as solid in a powder form or liquid. In one embodiment of the present disclosure, the detergent may include detergents of various types that may treat the laundry and enhance a washing effect.

In one example, the detergent feeder 100 may be installed at various locations and have various forms. FIGS. 1 and 2 show the detergent feeder 100 located at an upper front side inside the cabinet 10, but the present disclosure is not necessarily limited thereto.

For example, the detergent feeder 100 may be disposed at a lower side, one side, or a rear side inside the cabinet 10, or may be coupled to the cabinet 10 from the outside of the cabinet 10.

Hereinafter, for convenience of description, unless otherwise specified, the detergent feeder 100 is described as being built into the cabinet 10 as shown in FIGS. 1 and 2, but the scope of rights is not necessarily limited thereto.

Figure 3:
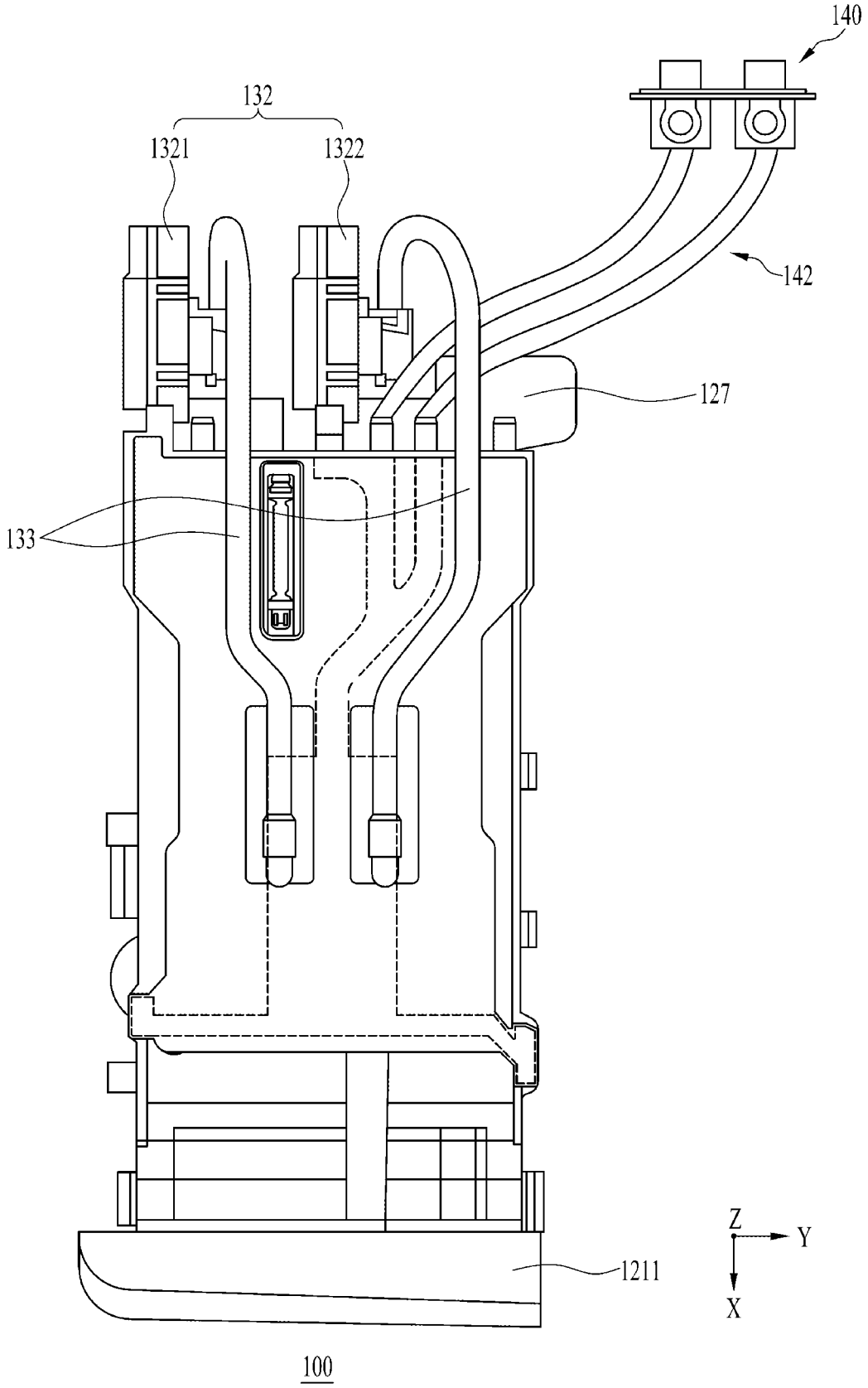
FIG. 3 is a top view showing a detergent feeder in an embodiment of the present disclosure.
Figure 4:
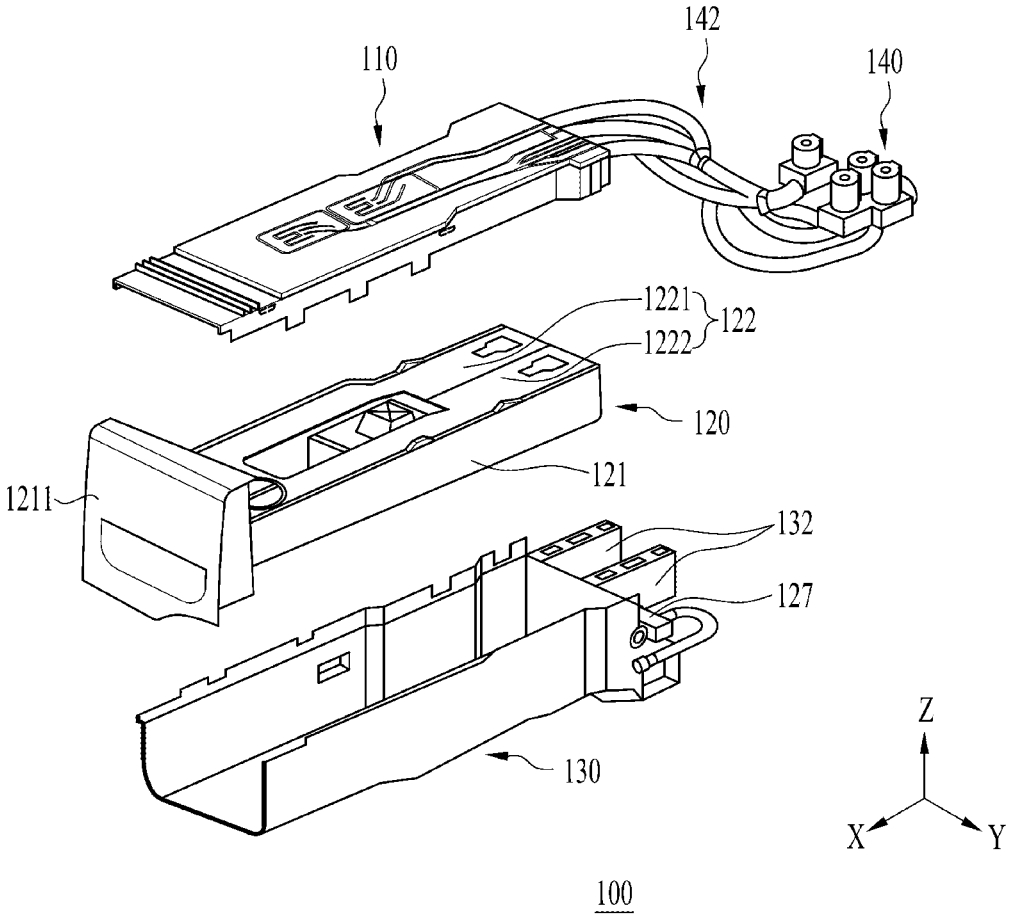
FIG. 4 is an exploded view showing a detergent feeder in an embodiment of the present disclosure.

In one example, FIG. 3 is a top view showing the detergent feeder 100 according to an embodiment of the present disclosure, and FIG. 4 is an exploded view showing the detergent feeder 100 according to an embodiment of the present disclosure.

Referring to FIGS. 3 and 4, in one embodiment of the present disclosure, the detergent feeder 100 may include a water supply unit 110, a detergent storage unit 120, and an accommodating casing 130.

The water supply unit 110 may supply water to the detergent feeder 100, and may be connected to a water supply hose 142 extending from the water supply valve 140 to receive water.

The water supply valve 140 is connected to an external water supply source of the laundry treating apparatus 1 according to one embodiment of the present disclosure to control a flow of water, and the water supply hose 142 connected to the water supply valve 140 becomes a path through which water that has passed through the water supply valve 140 flows.

The water supply valve 140 may be connected to the tub water supply pipe 35 to control the flow of water supplied to the tub 30, and the water supply valve 140 may be connected to the tub water supply pipe 35 via the detergent feeder 100.

For example, water that was supplied from the external water supply source and has passed through the water supply valve 140 may be delivered to the water supply unit 110 via the water supply hose 142, and water supplied to the detergent feeder 100 via the water supply unit 110 may be supplied into the tub 30 via the tub water supply pipe 35. However, the tub water supply pipe 35 may establish a connection relationship with the water supply valve 140 independently of the water supply hose 142, so that water that has passed through the water supply valve 140 may be delivered.

In one example, the detergent storage unit 120 may include the detergent storage space described above. In one embodiment of the present disclosure, the detergent storage unit 120 may include a detergent container 122 in which the detergent is stored, and an internal space of the detergent container 122 may correspond to at least a portion of the detergent storage space.

The detergent storage unit 120 may be separatable from the detergent feeder 100. For example, the detergent storage unit 120 may be removed from the water supply unit 110 described above and the accommodating casing 130 to be described later and extended to the outside of the cabinet 10.

The user may store the detergent in the detergent storage unit 120 by extending the detergent storage unit 120 to the outside of the cabinet 10, supplying the detergent into the detergent container 122, and then retracting the detergent storage unit 120 back into the cabinet 10.

However, as described above, in one embodiment of the present disclosure, the form of the detergent storage unit 120 is not necessarily limited as above. For example, at least a portion of the detergent feeder 100 may be disposed outside the cabinet 10, and the detergent container 122 may be coupled to the top plate, the front plate, or the like from the outside of the cabinet 10.

In one example, in one embodiment of the present disclosure, the accommodating casing 130 may be disposed inside the cabinet 10 to accommodate therein the detergent storage unit 120 that is retracted into the cabinet 10. The water supply unit 110 may be disposed to supply water into the detergent storage unit 120 and the accommodating casing 130 accommodated in the accommodating casing 130.

The accommodating casing 130 may include an accommodating space in which the detergent storage unit 120 is accommodated, and one surface of the accommodating space may be open and the water supply unit 110 may be disposed on the open one surface. For example, as shown in FIG. 4, in one embodiment of the present disclosure, the accommodating casing 130 may be formed in a shape with an open top surface, and the water supply unit 110 may be located above the accommodating casing 130 to form the top surface of the accommodating casing 130.

Accordingly, in one embodiment of the present disclosure, the detergent storage unit 120 may be inserted into the accommodating space in a rearward direction of the accommodating space that is defined by the water supply unit 110 and the accommodating casing 130 and is open forwardly.

In one embodiment of the present disclosure, water delivered to the water supply unit 110 via the water supply valve 140 and the water supply hose 142 may be discharged into the detergent storage unit 120 and the accommodating casing 130 via the water supply unit 110.

Water supplied from the water supply unit 110 to the detergent storage unit 120 may be discharged to the outside of the detergent storage unit 120 together with the detergent of the detergent storage unit 120. Water and the detergent discharged from the detergent storage unit 120 may be delivered to the accommodating space of the accommodating casing 130.

In the accommodating casing 130, water discharged from the water supply unit 110 and the detergent discharged from the detergent storage unit 120 may be discharged to the outside via a drain hole 131. Water and the detergent discharged via the drain hole 131 may be delivered to the tub water supply pipe 35 and supplied into the tub 30.

The drain hole 131 of the accommodating casing 130 may be in communication with the inside of the tub 30 via a separate water supply pipe disposed independently of the tub water supply pipe 35. For example, water and the detergent discharged from the drain hole 131 may flow along a detergent water supply pipe that is disposed separately from the tub water supply pipe 35 and extends from the drain hole 131, and be supplied into the tub 30 via the tub inlet or a hole defined in an outer surface of the tub 30.

Figure 5:
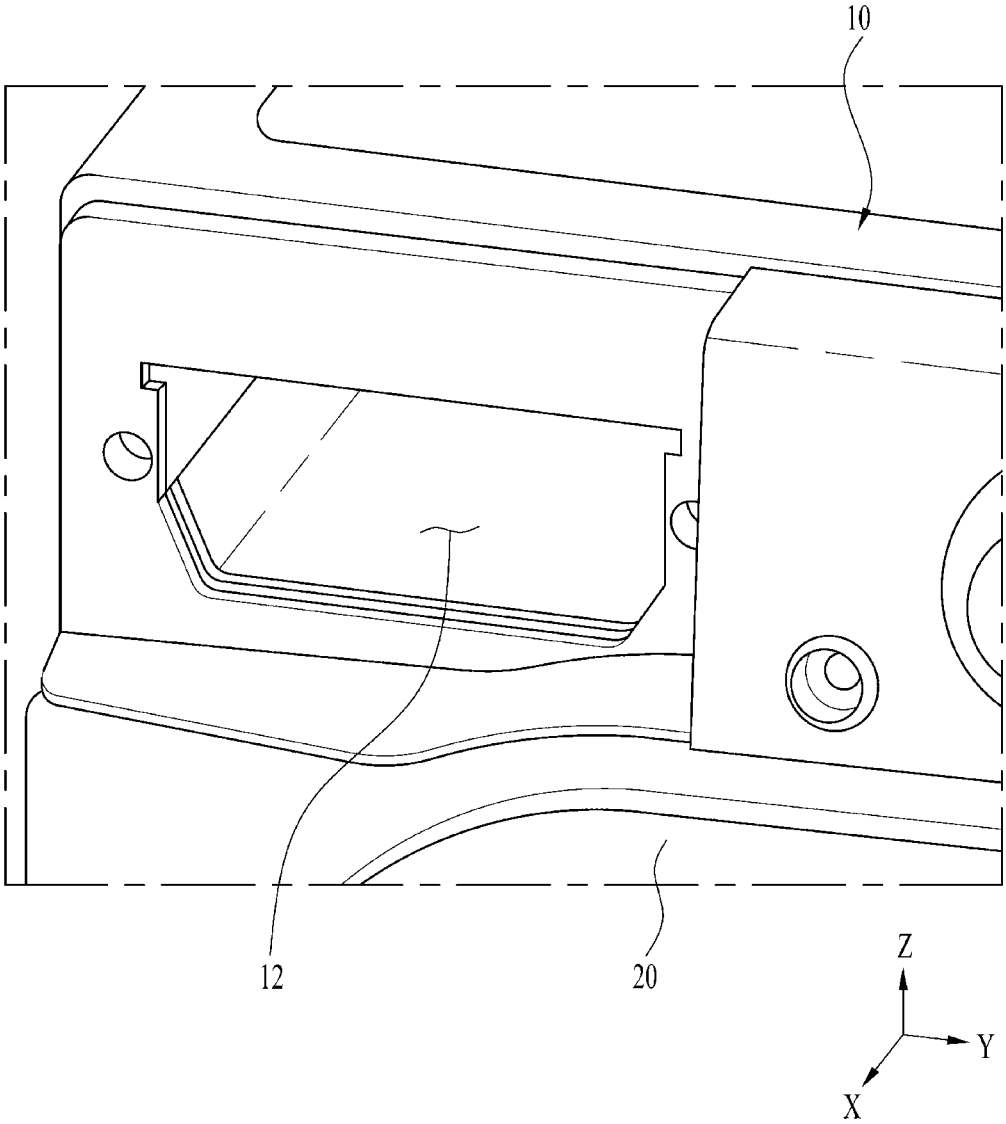
FIG. 5 shows a detergent inlet defined in a cabinet in an embodiment of the present disclosure.
Figure 6:
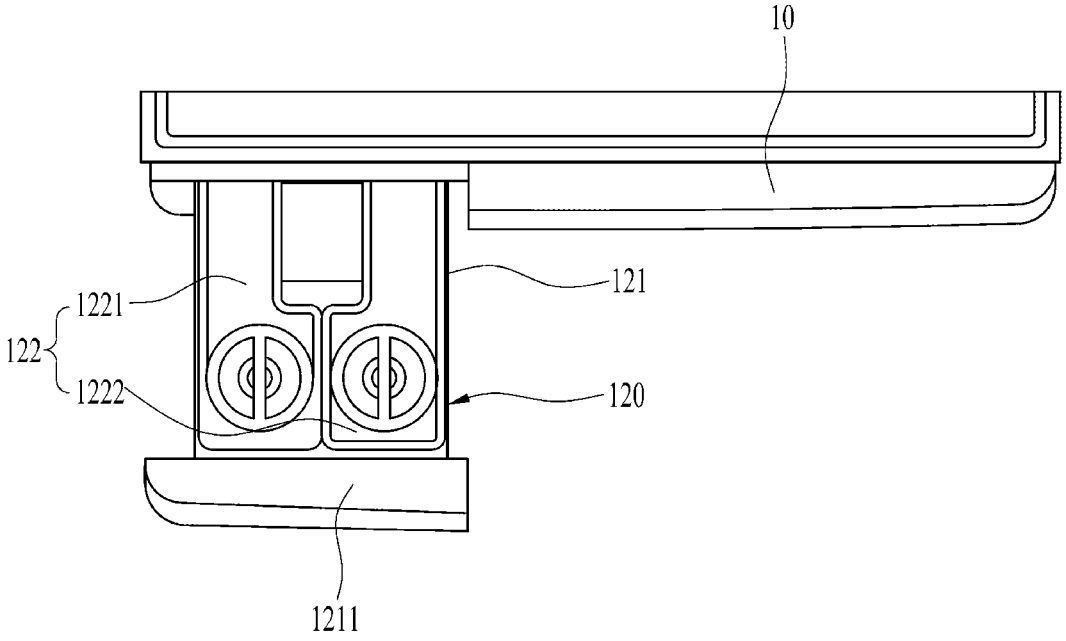
FIG. 6 shows a detergent storage unit retracted into a cabinet via a detergent inlet in an embodiment of the present disclosure.

In one example, FIG. 5 shows a detergent inlet 12 defined in the cabinet 10 according to an embodiment of the present disclosure, and FIG. 6 shows the detergent storage unit 120 retracted into the cabinet 10 via the detergent inlet 12.

As described above, in one embodiment of the present disclosure, the detergent storage unit 120 may include the detergent container 122, and may be removed from the detergent feeder 100 and extended to the outside of the cabinet 10.

The cabinet 10 may include the detergent inlet 12 through which the detergent storage unit 120 extends. The detergent inlet 12 may be defined in the front plate at a location spaced apart from the laundry inlet 15 as shown in FIG. 5, but the present disclosure may not be necessarily limited thereto.

The detergent storage unit 120 may include a storage frame 121 and a handle 1211. The detergent container 122 may be coupled to the storage frame 121 and may be retracted into or extended out of the cabinet 10 together with the storage frame 121.

The handle 1211 may be located at a front end of the storage frame 121. In a state in which the detergent storage unit 120 is completely retracted into the cabinet 10, the handle 1211 may be exposed to the outside of the cabinet 10 and gripped by the user.

As shown in FIGS. 5 and 6, when the detergent inlet 12 is defined in the front plate of the cabinet 10, the detergent storage unit 120 may be inserted into the cabinet 10 via the detergent inlet 12 in the front plate, and the handle 1211 may be located outside the cabinet 10 and form a front outer appearance of the laundry treating apparatus 1 together with the front plate.

Figure 7:
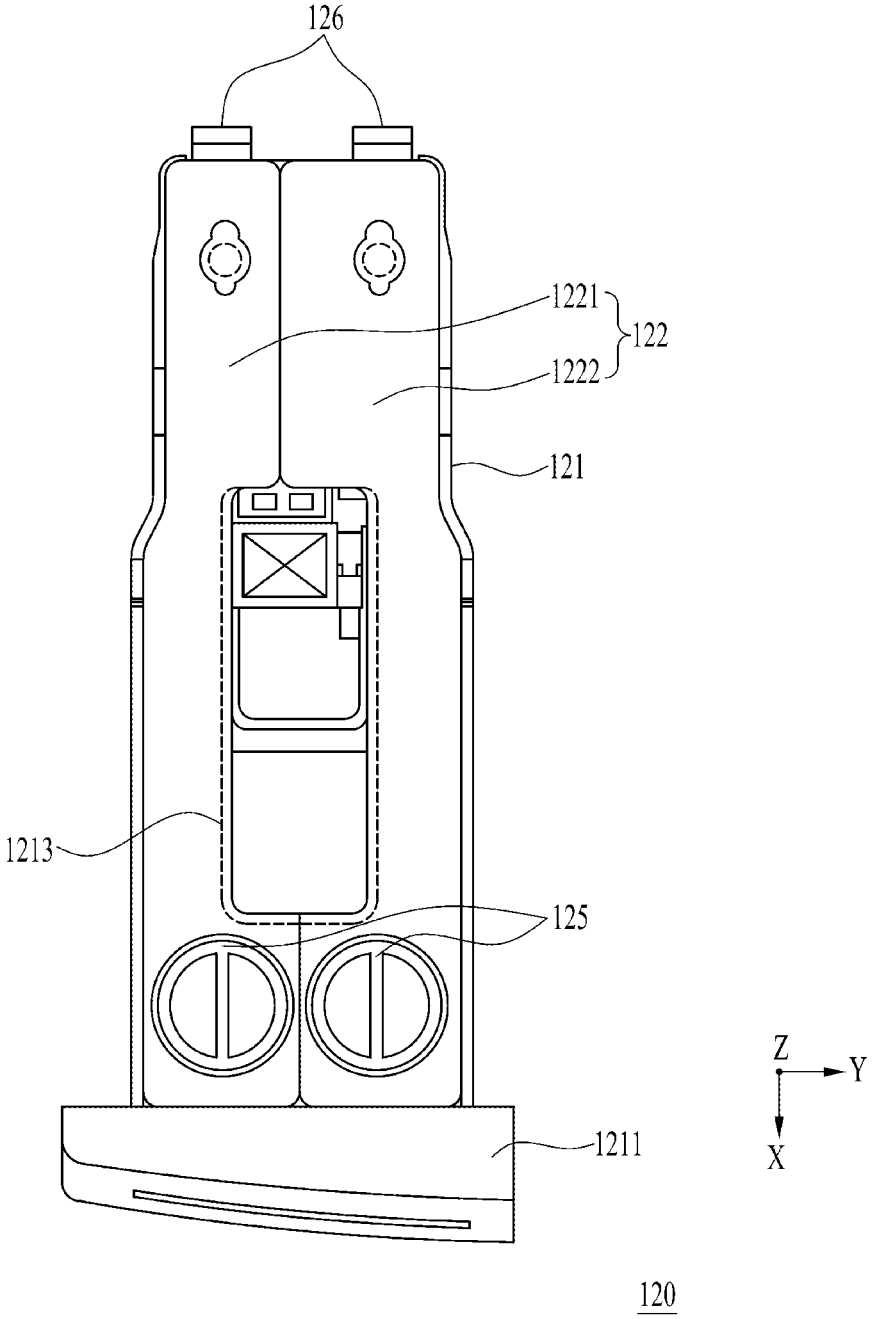
FIG. 7 is a top view of a detergent storage unit of a detergent feeder in an embodiment of the present disclosure.
Figure 8:
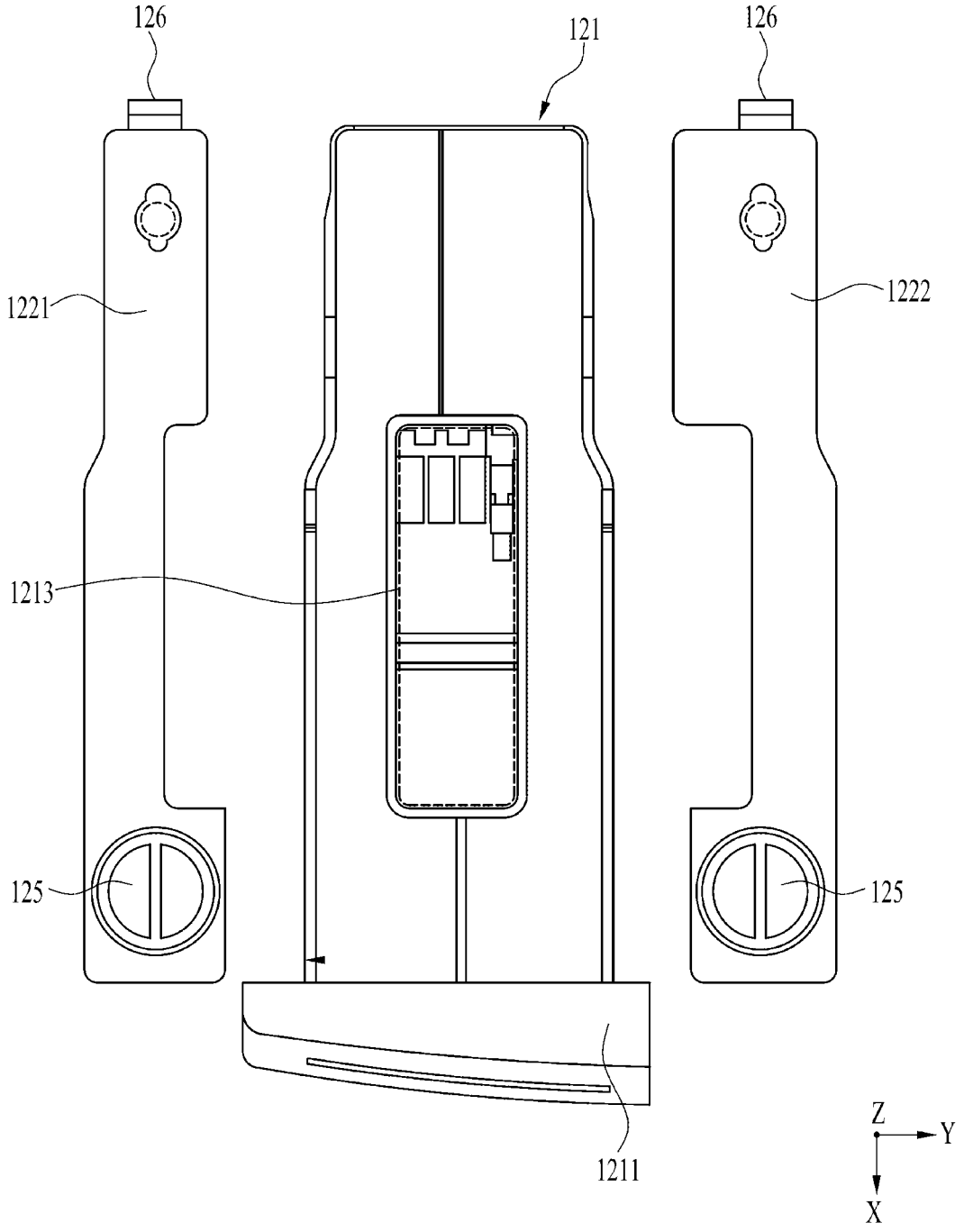
FIG. 8 is an exploded view showing a detergent storage unit of a detergent feeder in an embodiment of the present disclosure.

In one example, FIG. 7 is a top view of the detergent storage unit 120 according to an embodiment of the present disclosure, and FIG. 8 is a view showing the detergent container 122 removed from the detergent storage unit 120 according to one embodiment of the present disclosure.

As described above, the detergent storage unit 120 may include the storage frame 121 and the detergent container 122, and the storage frame 121 may include the above-described handle 1211, and may have a coupling space defined therein in which the detergent container 122 is coupled.

Additionally, the storage frame 121 may include a detergent accommodating area 1213 in which the detergent may be stored independently of the detergent container 122. The detergent accommodating area 1213 may correspond to a portion of the detergent storage space described above. That is, in one embodiment of the present disclosure, the detergent storage unit 120 may store the detergent in the detergent storage space including the internal space of the detergent container 122 and the detergent accommodating area 1213.

In one embodiment of the present disclosure, the detergent storage unit 120 may include the plurality of detergent containers 122. For example, as shown in FIGS. 7 and 8, in one embodiment of the present disclosure, the detergent container 122 may include a first detergent container 1221 and a second detergent container 1222. However, the number of detergent containers 122 may vary depending on need.

The first detergent container 1221 and the second detergent container 1222 may be formed independently of each other, and may store different detergents therein, respectively. In addition, the detergent accommodating area 1213 described above may be partitioned from the first detergent container 1221 and the second detergent container 1222 and store another detergent therein.

For example, the liquid detergent may be stored inside the detergent container 122, which ensures watertightness, and the powder detergent may be stored in the detergent accommodating area 1213, where easy detergent replenishment is possible. However, the present disclosure may not be necessarily limited thereto, and the type and the form of the detergents stored in the detergent container 122 and the detergent accommodating area 1213 may vary.

Figure 9:
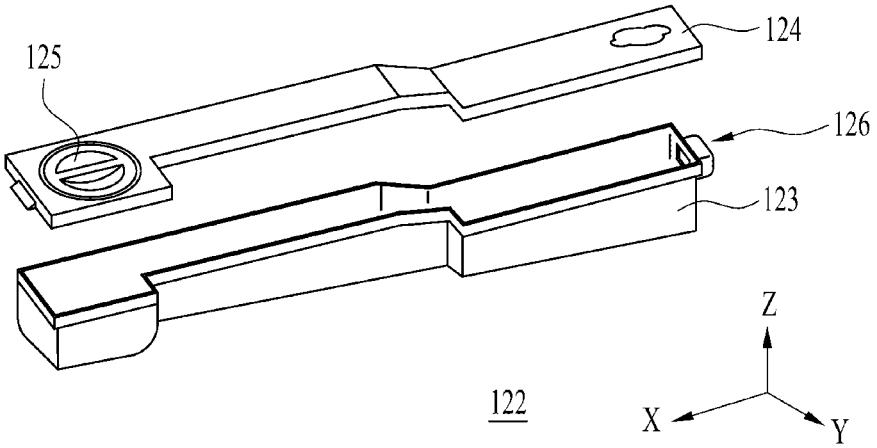
FIG. 9 shows an exploded view of a detergent container of a detergent storage unit in an embodiment of the present disclosure.

In one example, FIG. 9 shows an exploded view of the detergent container 122 according to an embodiment of the present disclosure. Referring to FIG. 9, in one embodiment of the present disclosure, the detergent container 122 may include a storage body 123 and a storage cover 124.

The storage body 123 may have a storage space in which the detergent is stored, and a top surface thereof may be opened to expose the storage body 123 upward. The storage cover 124 may be coupled to the storage body 123 to shield the open top surface of the storage body 123.

However, the present disclosure is not necessarily limited thereto, and the storage body 123 and the storage cover 124 may be integrally molded to define the sealed storage space therebetween.

In one example, the storage cover 124 may include a detergent cap 125. The storage cover 124 may include an opening, and the detergent cap 125 may be detachably coupled to the storage cover 124 to shield the opening.

In one embodiment of the present disclosure, the opening in communication with the storage space inside the detergent container 122 is defined in the storage cover 124, and the opening is shielded via the detergent cap 125 that is detachably coupled to the storage cover 124, allowing the user to supply the detergent into the detergent container 122 via the opening of the storage cover 124 by easily removing only the detergent cap 125 from the storage cover 124 without having to remove the detergent container 122 from the storage frame 121 or remove the storage cover 124 from the storage body 123.

Figure 10:
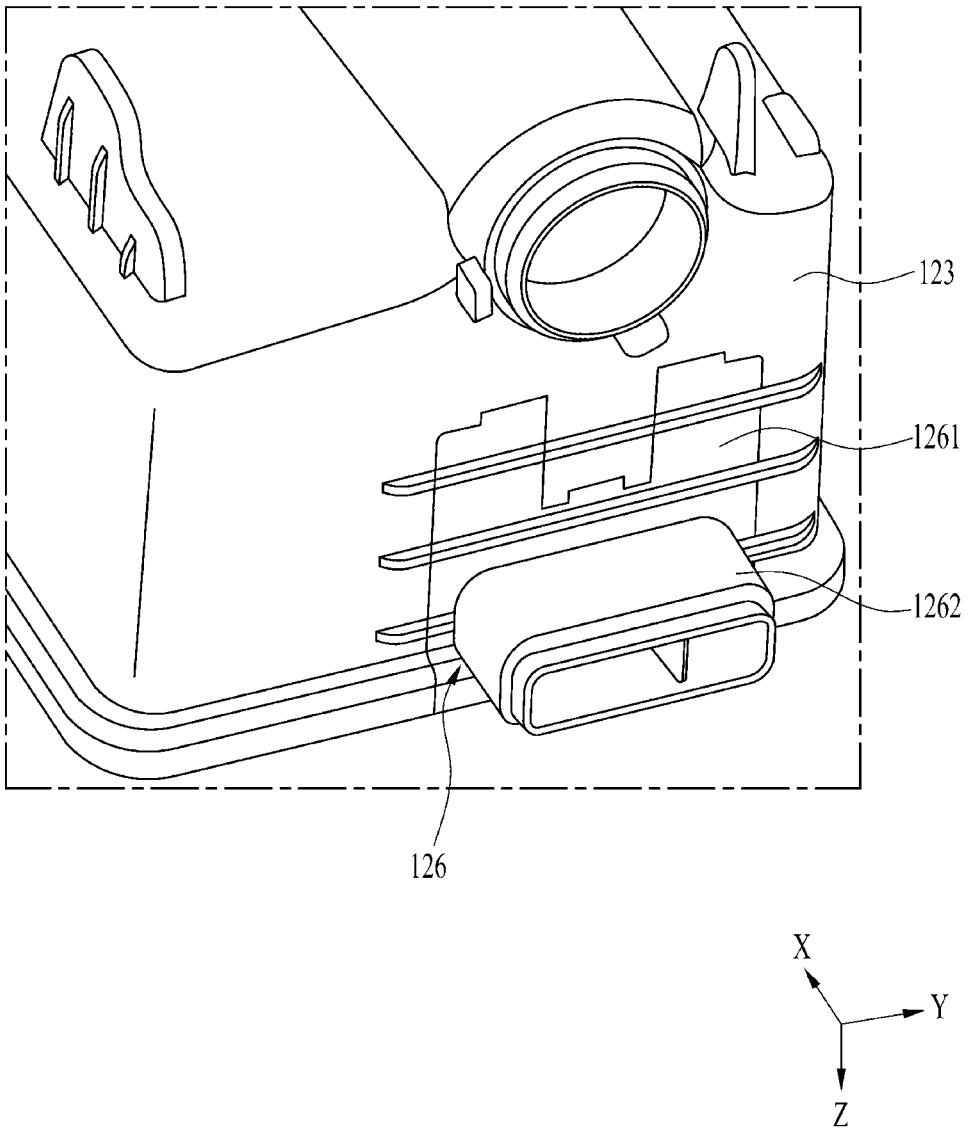
FIG. 10 shows a remaining amount detector of a detergent container in an embodiment of the present disclosure.

In one example, FIG. 10 shows a remaining amount detector 126 disposed on the detergent container 122. Referring to FIGS. 9 and 10, one embodiment of the present disclosure may include the remaining amount detector 126 that may detect remaining amounts of the detergents in the first detergent container 1221 and the second detergent container 1222.

The remaining amount detector 126 may be disposed on the storage frame 121 or the accommodating casing 130, or may be disposed on the detergent container 122. FIG. 10 shows the remaining amount detector 126 disposed on a rear surface of the storage body 123 of the detergent container 122 according to one embodiment of the present disclosure.

In one embodiment of the present disclosure, the remaining amount detector 126 may be disposed to form at least a portion of the rear surface of the storage body 123, and may include a contact portion that is in contact with the detergent to detect the remaining amount of the detergent.

For example, a plurality of contact portions may be arranged to conduct electricity to each other in response to contact with the detergent, allowing the remaining amount of the detergent to be measured based on whether the contact portions conduct electricity.

The remaining amount detector 126 may be disposed on each of the first detergent container 1221 and the second detergent container 1222 to detect the remaining amount of the detergent in each of the first detergent container 1221 and the second detergent container 1222, and may be connected to the controller 200 to transmit a detection signal for the remaining amount to the controller 200.

In one example, the remaining amount detector 126 may include a detecting body 1261 and a detecting terminal 1262, and the detecting body 1261 may form at least a portion of the storage body 123. The detecting body 1261 may have the above-mentioned contact portion, and the contact portion may be exposed to the storage space and come into contact with the detergent.

The detecting terminal 1262 may be electrically or signally connected to the controller 200 via a wire or the like, and an electrical signal generated via the contact between the contact portion and the detergent may be transmitted from the detecting terminal 1262 to the controller 200 via the wire or the like. The controller 200 may identify the remaining amount of the detergent in the detergent container 122 by receiving the electrical signal transmitted via the detecting terminal 1262.

However, in one embodiment of the present disclosure, the type, the location, and the shape of the remaining amount detector 126 may not be limited as above, and the remaining amount detector 126 may be of various types and may be disposed at various locations as needed.

Figure 11:
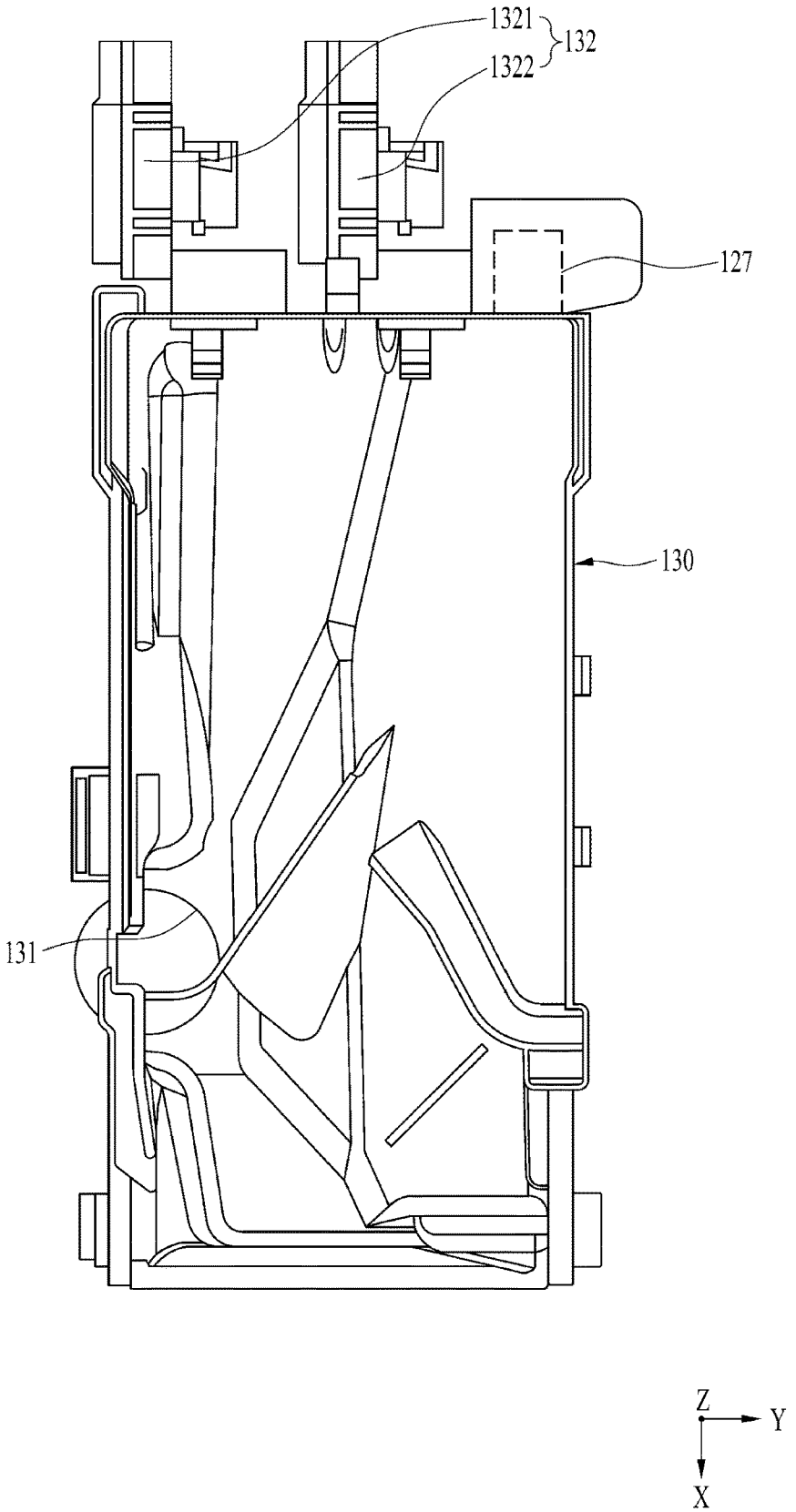
FIG. 11 shows an accommodating casing of a detergent feeder in an embodiment of the present disclosure.

In one example, FIG. 11 shows the accommodating casing 130 according to one embodiment of the present disclosure. Referring to FIG. 11, one embodiment of the present disclosure may have a detergent container detector 127 that detects whether the first detergent container 1221 and the second detergent container 1222 are inserted into the accommodating casing 130.

In one embodiment of the present disclosure, the first detergent container 1221 and the second detergent container 1222 may be detachably disposed in the detergent feeder 100. That is, the first detergent container 1221 and the second detergent container 1222 may be removably coupled to the detergent feeder 100.

A coupling scheme between the first detergent container 1221 and the second detergent container 1222 and the detergent feeder 100 may vary. For example, as described above, the first detergent container 1221 and the second detergent container 1222 may be coupled to the storage frame 121 and may be retracted into and extended from the cabinet 10.

Additionally, the detergent feeder 100 may be formed such that at least a portion thereof is exposed to the outside of the cabinet 10, and the first detergent container 1221 and the second detergent container 1222 may be detachably coupled to the externally exposed portion of the detergent feeder 100.

Hereinafter, for convenience of description, unless otherwise specified, a description will be made based on the first detergent container 1221 and the second detergent container 1222 being removable from the detergent feeder 100 by being retracted into or extended out of the cabinet 10 in a state of being coupled to the storage frame 121 of the detergent storage unit 120.

The detergent container detector 127 may detect whether the first detergent container 1221 and the second detergent container 1222 are coupled to the detergent feeder 100, for example, the accommodating casing 130. The detergent container detector 127 may be disposed on the storage frame 121 of the detergent storage unit 120 or on the accommodating casing 130.

FIG. 11 schematically shows the detergent container detector 127 disposed on a rear surface of the accommodating casing 130 according to one embodiment of the present disclosure. Referring to FIG. 11, the detergent container detector 127 may be disposed on the accommodating casing 130 and detect whether the detergent storage unit 120 is inserted, thereby detecting whether the first detergent container 1221 and the second detergent container 1222 are mounted.

For example, the detergent container detector 127 may generate an electrical signal when pressed by or in contact with the storage frame 121 accommodated into the accommodating casing 130. Because the first detergent container 1221 and the second detergent container 1222 are inserted into the cabinet 10 together with the storage frame 121, a detection signal of the detergent container detector 127 may indicate that the first container and the second container are mounted in the detergent feeder 100.

The detergent container detector 127 may be electrically connected or signal-connected to the controller 200, and the controller 200 may determine whether the first detergent container 1221 and the second detergent container 1222 are accommodated via the electrical signal of the detergent container detector 127.

Figure 12:
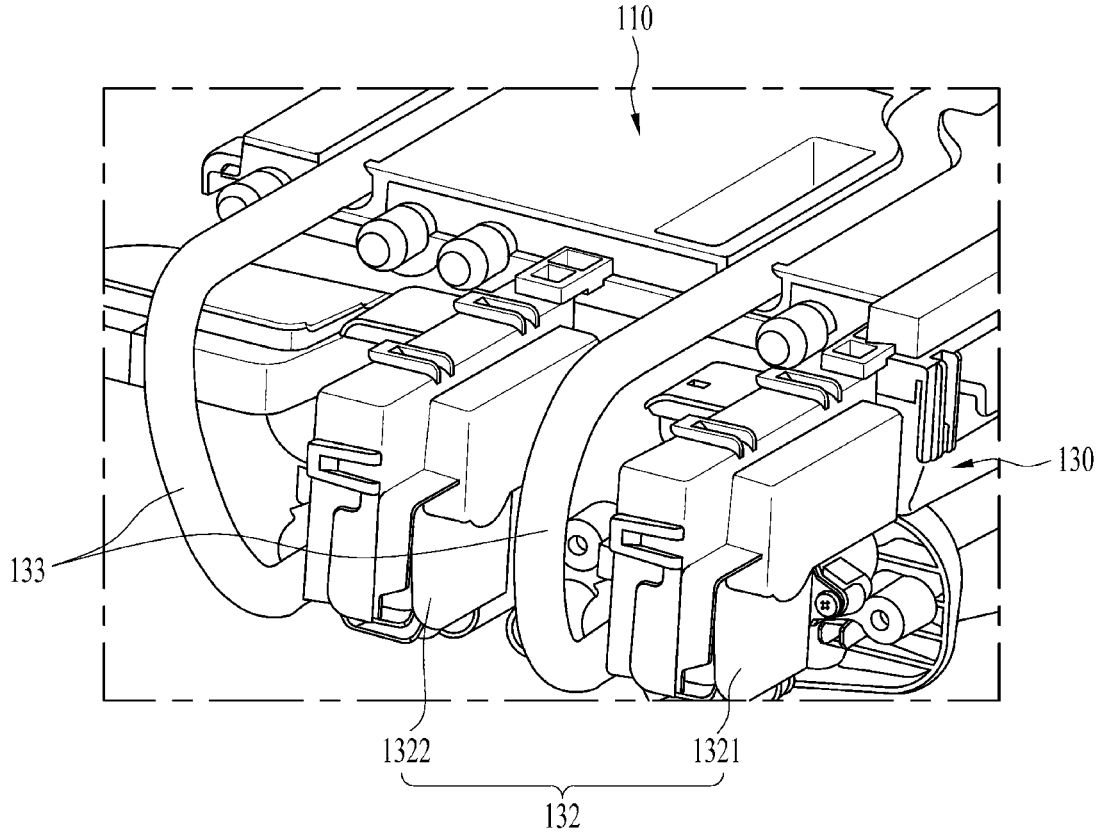
FIG. 12 shows a detergent pump of a detergent feeder in an embodiment of the present disclosure.

In one example, FIG. 12 shows a detergent pump 132 and a detergent hose 133 disposed in the accommodating casing 130. Referring to FIGS. 11 and 12, one embodiment of the present disclosure may include the detergent pump 132 for discharging the detergent stored in the detergent container 122.

As described above, the detergent container 122 may include the first detergent container 1221 and the second detergent container 1222, and the detergent pump 132 may include a first detergent pump 1321 connected to the first detergent container 1221 and a second detergent pump 1322 connected to the second detergent container 1222.

The detergent pump 132 may be disposed on the accommodating casing 130. As described above, in one embodiment of the present disclosure, the detergent storage unit 120 may be retracted into the cabinet 10 via the detergent inlet 12 defined in the front plate, and the detergent pump 132 may be disposed on the rear surface of the accommodating casing 130 to be connected to the detergent container 122 of the detergent storage unit 120 completely accommodated inside the accommodating casing 130.

The detergent pump 132 may be disposed to discharge the detergent inside the detergent container 122. For example, the liquid detergent may be stored inside the detergent container 122, and the detergent pump 132 may discharge the liquid detergent inside the detergent container 122 to the outside of the detergent container 122.

The detergent discharged from the detergent container 122 via the detergent pump 132 may flow through the detergent hose 133 connected to the detergent pump 132. The detergent discharged from the detergent container 122 via the detergent pump 132 may ultimately be provided into the tub 30.

There may be various schemes in which the detergent discharged via the detergent pump 132 is supplied into the tub 30. For example, the detergent hose 133 may be connected to the tub 30, the tub water supply pipe 35, or the like from the detergent pump 132, and the detergent discharged from the detergent container 122 via the detergent pump 132 may be supplied into the tub 30 to the tub water supply pipe 35 along the detergent hose 133.

Additionally, the detergent hose 133 extending from the detergent pump 132 may be in communication with the interior of the accommodating casing 130. Therefore, the detergent discharged from the detergent container 122 may be discharged into the accommodating casing 130 by flowing along the detergent hose 133, and the detergent inside the accommodating casing 130 may flow into the tub 30 via the drain hole 131 of the accommodating casing 130 along with water supplied from the water supply unit 110.

Additionally, the detergent hose 133 extending from the detergent pump 132 may be connected to the water supply unit 110. Therefore, the detergent discharged from the detergent container 122 may be supplied to the water supply unit 110, the water supply unit 110 may discharge water and the detergent together into the accommodating casing 130, and water and the detergent inside the accommodating casing 130 may be delivered into the tub 30 via the drain hole 131 as described above.

FIG. 12 shows the detergent pump 132 coupled to the rear surface of the accommodating casing 130 from the rear according to one embodiment of the present disclosure, and shows the detergent hose 133 extending from the detergent pump 132 and connected to the water supply unit 110.

Figure 13:
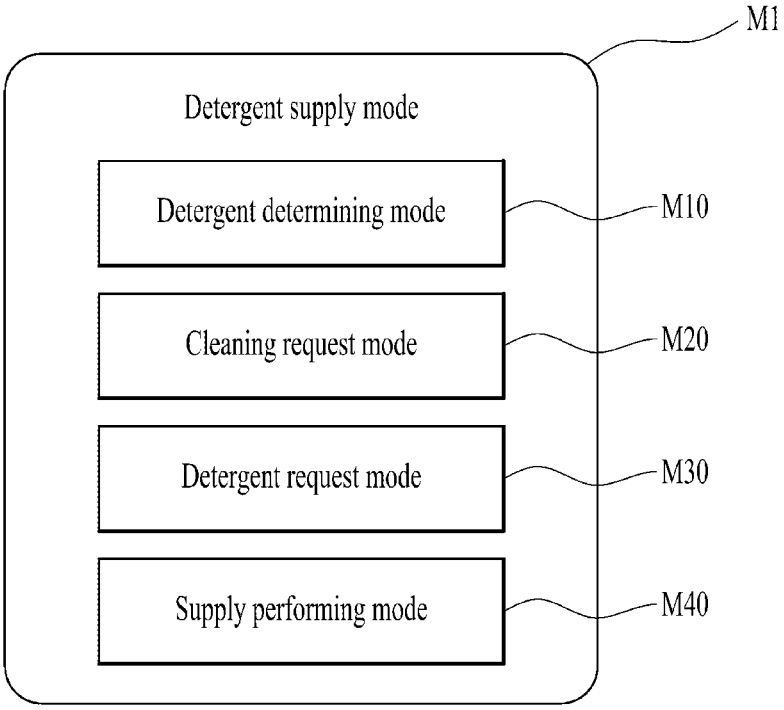
FIG. 13 shows a conceptual diagram showing a detergent supply mode in a laundry treating apparatus according to an embodiment of the present disclosure.

In one example, FIG. 13 shows a conceptual diagram showing a detergent supply mode M1 in the laundry treating apparatus 1 according to an embodiment of the present disclosure. Referring to FIG. 13, in one embodiment of the present disclosure, the controller 200 may perform the detergent supply mode M1 in the washing cycle of the laundry.

In the detergent supply mode M1, the controller 200 may control the detergent feeder 100 and the like and supply the detergent into the tub 30 or the drum 40 to wash the laundry. The detergent supply mode M1 may be performed during the washing process to remove the contaminants from the laundry using the detergent in the washing cycle of the laundry.

The detergent supply mode M1 may include a detergent determining mode M10, a cleaning request mode M20, a detergent request mode M30, and a supply performing mode M40. In the detergent determining mode M10, the controller 200 may determine the detergent to be used for the washing process.

As described above, in one embodiment of the present disclosure, the detergent storage unit 120 may include the first detergent container 1221 and the second detergent container 1222, and the first detergent container 1221 and the second detergent container 1222 may include the storage spaces of the detergents that are independent of each other.

In other words, the same type of detergent or the different detergents may be stored in the first detergent container 1221 and the second detergent container 1222 depending on user's selection. Accordingly, the controller 200 may determine whether to use each of the first detergent container 1221 and the second detergent container 1222 and use a necessary detergent via the detergent determining mode M10.

Figure 14:
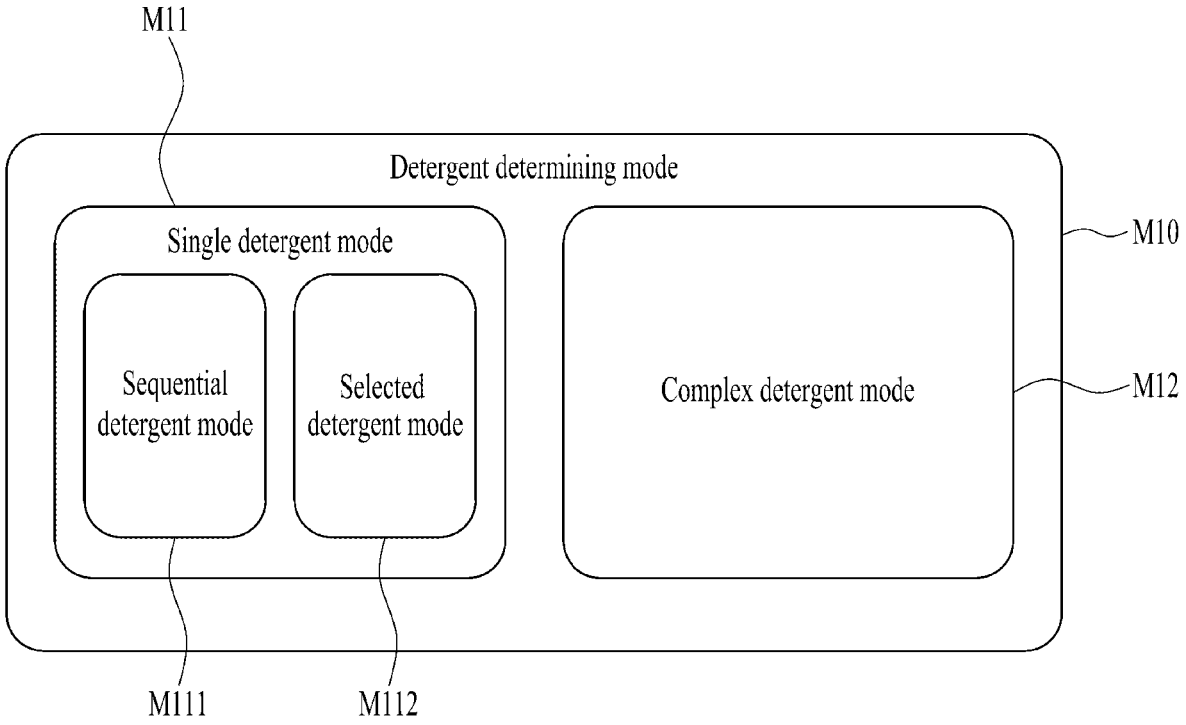
FIG. 14 is a conceptual diagram showing a detergent determining mode in a laundry treating apparatus in an embodiment of the present disclosure.

In one example, FIG. 14 is a conceptual diagram showing the detergent determining mode M10 in the laundry treating apparatus 1 according to an embodiment of the present disclosure. Referring to FIG. 14, in one embodiment of the present disclosure, the controller 200 may select one of a single detergent mode M11 and a complex detergent mode M12 in the detergent determining mode M10.

The single detergent mode M11 may supply the detergent to the tub 30 from one of the first detergent container 1221 and the second detergent container 1222, and the complex detergent mode M12 may supply the detergent to the tub 30 from both of the first detergent container 1221 and the second detergent container 1222.

Specifically, the user may store the different types of detergents in the first detergent container 1221 and the second detergent container 1222. For example, the laundry detergent may be stored in the first detergent container 1221, and the softener may be stored in the second detergent container 1222.

In one embodiment of the present disclosure, when the washing cycle is performed without using the softener by the user's choice or determination of the controller 200, the controller 200 may select and perform the single detergent mode M11 in the detergent determining mode M10.

It has been described above that the detergents in the first detergent container 1221 and the second detergent container 1222 are the laundry detergent and the softener, respectively, but the present disclosure is not limited thereto. Even when different types of laundry detergents are stored or the bleaching agent is stored in the first detergent container 1221 and the second detergent container 1222, the single detergent mode M11 may be used.

In one example, in the complex detergent mode M12, as described above, the detergents from the first detergent container 1221 and the second detergent container 1222 may be simultaneously leaked and supplied into the tub 30. In the washing cycle, when the laundry detergent in the first detergent container 1221 and the softener in the second detergent container 1222 are needed at the same time by the user's choice or the determination of the controller 200, the controller 200 may select the complex detergent mode M12 in the detergent determining mode M10 and perform the detergent supply mode M1.

One embodiment of the present disclosure has the first detergent container 1221 and the second detergent container 1222 that may store the detergents independently of each other, so that the user may store various types of detergents together in the detergent feeder 100 depending on convenience.

Furthermore, in one embodiment of the present disclosure, the various detergents stored in the first detergent container 1221 and the second detergent container 1222 may be selectively used during the washing cycle via the single detergent mode M11 and the complex detergent mode M12, thereby effectively improving convenience of use.

In one example, in one embodiment of the present disclosure, the controller 200 may select one of the single detergent mode M11 and the complex detergent mode M12 based on the manipulation signal input by the user via the manipulator 50 disposed on the cabinet 10 or the communication terminal 300 portable by the user.

As described above, the user may input the manipulation signal via the manipulator 50 or the communication terminal 300. The manipulation signal may include a single detergent signal and a complex detergent signal, and the controller 200 may select and proceed with the single detergent mode M11 when the single detergent signal is input, and select and proceed with the complex detergent mode M12 when the complex detergent signal is input.

In one example, the user may input a type of the laundry accommodated inside the drum 40 via the manipulator 50 or the communication terminal 300, and the controller 200 may select one of the single detergent mode M11 and the complex detergent mode M12 to match the corresponding laundry, via the manipulation signal indicating the type of the laundry.

The controller 200 may be electrically connected or signal-connected to the detergent pump 132, and may control use of the detergents in the first detergent container 1221 and the second detergent container 1222 via control of the detergent pump 132.

Specifically, the controller 200 may operate the first detergent pump 1321 in the single detergent mode M11 to use the detergent in the first detergent container 1221, or operate the second detergent pump 1322 to use the detergent in the second detergent container 1222.

Additionally, the controller 200 may operate the first detergent pump 1321 and the second detergent pump 1322 together in the complex detergent mode M12 to use the detergents in the first detergent container 1221 and the second detergent container 1222 simultaneously.

In one example, in one embodiment of the present disclosure, the single detergent mode M11 may include a sequential detergent mode M111. In the sequential detergent mode M111, the controller 200 may supply the detergent in the first detergent container 1221 to the tub 30 when an amount of detergent in the first detergent container 1221 is equal to or greater than a reference amount, and may supply the detergent in the second detergent container 1222 to the tub 30 when the amount of detergent in the first detergent container 1221 is smaller than the reference amount.

The sequential detergent mode M111 may be performed when the same type of detergent is stored in the first detergent container 1221 and the second detergent container 1222. For example, the user may store the same detergent, for example, the laundry detergent, in the first detergent container 1221 and the second detergent container 1222, and transmit a manipulation signal to the controller 200 to select and perform the sequential detergent mode M111 using the manipulator 50 or the communication terminal 300.

The manipulation signal may include a sequential detergent signal for selecting the sequential detergent mode M111. When the manipulation signal received from the manipulator 50 or the communication terminal 300 is the sequential detergent signal, the controller 200 may select the sequential detergent mode M111 from the detergent determining mode M10, and proceed with the detergent supply mode M1.

In the case of the sequential detergent mode M111, as described above, it is desirable for the same detergent to be stored in the first detergent container 1221 and the second detergent container 1222. Therefore, as the detergent may be stored together in the first detergent container 1221 and the second detergent container 1222, a storage capacity for the same type of detergent may be effectively increased.

In the sequential detergent mode M111, the controller 200 may preferentially use the detergent in one of the first detergent container 1221 and the second detergent container 1222. For convenience of description, hereinafter, a description will be made focusing on a case in which the detergent in the first detergent container 1221 is used in preference to the detergent in the second detergent container 1222, but the order of use of the first detergent container 1221 and the second detergent container 1222 may be changed.

In the sequential detergent mode M111, the controller 200 may operate the first detergent pump 1321 to use the detergent in the first detergent container 1221 for the washing process. However, the controller 200 may use the detergent in the first detergent container 1221 by operating the first detergent pump 1321 when the detergent remaining amount of the first detergent container 1221 detected by the remaining amount detector 126 is equal to or greater than the preset reference amount.

In one example, when the amount of the detergent in the first detergent container 1221 detected by the remaining amount detector 126 described above is smaller than the reference amount, the controller 200 may stop using the detergent in the first detergent container 1221 and use the detergent in the second detergent container 1222. In other words, the controller 200 may operate the second detergent pump 1322 instead of the first detergent pump 1321 and use the detergent in the second detergent container 1222 instead of the first detergent container 1221 in the washing process.

The reference amount may be preset and stored in the controller 200, or may be predetermined by design via structural characteristics of the remaining amount detector 126. For example, the remaining amount detector 126 may determine the remaining amount of detergent from which the detection signal is generated depending on the location of the contact portion described above.

In one example, in one embodiment of the present disclosure, the reference amount of detergent may mean a detergent remaining amount that corresponds to or adjacent to a value of '0', and thus, is insufficient to perform the washing process.

In one embodiment of the present disclosure, the remaining amount detector 126 may be located such that the contact portion is adjacent to or touches a bottom of the storage body 123. Thus, when the detergent inside the detergent container 122 is all exhausted or in a state similar thereto, that is, when only a small amount that is smaller than the reference amount exists, a signal of the remaining amount detector 126 changes, and thus, the controller 200 is able to determine whether the amount of detergent in the first detergent container 1221 is smaller than the reference amount.

For example, the remaining amount detector 126 may generate a remaining amount detection signal when the amount of detergent in the detergent container 122 is smaller than the reference amount, and, when receiving the remaining amount detection signal, the controller 200 may determine that the amount of detergent in the detergent container 122 is smaller than the reference amount.

In one example, the remaining amount detector 126 may continue to generate the remaining amount detection signal when the amount of detergent in the detergent container 122 is equal to or greater than the reference amount, the generation of the remaining amount detection signal may be stopped when the amount of detergent is smaller than the reference amount, and the controller 200 may determine that the amount of detergent in the detergent container 122 is smaller than the reference amount when the remaining amount detection signal is stopped.

In summary, in one embodiment of the present disclosure, the detergent feeder 100 may include the remaining amount detector 126 that detects the remaining amounts of detergents in the first detergent container 1221 and the second detergent container 1222, and the controller 200 may determine whether the remaining amount of detergent in the first detergent container 1221 is equal to or greater than the reference amount based on the remaining amount detection signal of the remaining amount detector 126.

One embodiment of the present disclosure may effectively increase the storage capacity of the detergent and improve efficiency of detergent use via the sequential detergent mode M111 that may store and utilize the same detergent in the first detergent container 1221 and the second detergent container 1222.

In one example, referring to FIG. 13, in one embodiment of the present disclosure, the controller 200 may execute the detergent request mode M30 of requesting the user to supply the detergent when the remaining amount of each of the detergents in the first detergent container 1221 and the second detergent container 1222 is smaller than the reference amount in the sequential detergent mode M111.

Specifically, in the washing process from which the sequential detergent mode M111 is selected, the controller 200 may use only the detergent in the first detergent container 1221 when the remaining amount of detergent in the first detergent container 1221 is equal to or greater than the reference amount, and may use only the detergent in the second detergent container 1222 when the remaining amount of detergent in the first detergent container 1221 is smaller than the reference amount.

However, when the detergent remaining amounts of both the first detergent container 1221 and the second detergent container 1222 are smaller than the reference amount, the controller 200 may determine that there is not enough detergent to perform the washing process and execute the detergent request mode M30.

When the detergent request mode M30 is executed, the controller 200 may maintain the detergent supply mode M1 and the washing process stopped. When it is identified that the detergent has been replenished by the user, the detergent supply mode M1 and the washing process may be continued. The controller 200 may determine whether to replenish the detergent based on the remaining amount detection signal of the remaining amount detector 126 in the detergent request mode M30.

In one example, in one embodiment of the present disclosure, the controller 200 may provide visual information or auditory information to the user via the notifier 60 disposed on the cabinet 10 or the communication terminal 300 portable by the user in the detergent request mode M30 to request the supply of the detergent.

In the detergent request mode M30, the controller 200 may transmit a detergent request signal to the notifier 60 or the communication terminal 300 described above, and the notifier 60 or the communication terminal 300 that has received the detergent request signal may request the user to replenish the detergent via the visual information or the auditory information.

The notifier 60 may transmit, to the user, the auditory information via the speaker or the visual information via the display to inform the user that the detergent replenishment is necessary.

The communication terminal 300 may transmit, to the user, the auditory information via the speaker, the visual information via the display, or a vibration signal of the communication terminal 300. The communication terminal 300 may provide a push notification, a sound notification, and the like to the user via an application pre-stored in the communication terminal 300.

In one embodiment of the present disclosure, the detergent request mode M30 may be executed in the same manner when the detergent remaining amount is insufficient not only in the aforementioned sequential detergent mode M111 but also in a selected detergent mode M112 and the complex detergent mode M12 to be described later.

One embodiment of the present disclosure may transmit a signal requesting the detergent via the notifier 60 disposed on the cabinet 10 as well as the communication terminal 300 corresponding to the user's mobile phone or the like, thereby effectively improving convenience of use of the user.

In one example, referring to FIG. 14, in one embodiment of the present disclosure, the single detergent mode M11 may further include the selected detergent mode M112. The controller 200 may control the detergent feeder 100 to supply the detergent to the tub 30 via one of the first detergent container 1221 and the second detergent container 1222 in the selected detergent mode M112.

The controller 200 may select one of the sequential detergent mode M111 and the selected detergent mode M112 based on the manipulation signal input by the user via the manipulator 50 disposed on the cabinet 10 or the communication terminal 300 portable by the user.

Specifically, in one embodiment of the present disclosure, the single detergent mode M11 may further include the selected detergent mode M112 in addition to the sequential detergent mode M111 described above. The manipulation signal that the user may transmit to the controller 200 via the manipulator 50 and/or the communication terminal 300 may include a selected detergent signal as well as the sequential detergent signal.

The controller 200 may select and execute the sequential detergent mode M111 when the manipulation signal received from the manipulator 50 or the communication terminal 300 corresponds to the sequential detergent signal, and select and execute the selected detergent mode M112 when the manipulation signal corresponds to the selected detergent signal.

In the selective detergent mode M112, the controller 200 may perform the washing process using one of the first detergent container 1221 and the second detergent container 1222. As described above, the first detergent container 1221 and the second detergent container 1222 may contain the different types of detergents, and the selection detergent mode M112 may allow an appropriate detergent to be selected and used among the detergents in the first detergent container 1221 and the second detergent container 1222 in preference to the washing process to be currently performed.

For example, the user may store a laundry detergent for adults in the first detergent container 1221 and a laundry detergent for children in the second detergent container 1222. When the laundry currently stored in the drum 40 is for the children, the controller 200 may perform the washing cycle using only the detergent in the second detergent container 1222 that matches the laundry for the children.

One embodiment of the present disclosure may allow the user to store the different types of detergents in the first detergent container 1221 and the second detergent container 1222 and effectively use the detergents as needed via the selected detergent mode M112.

In one example, in one embodiment of the present disclosure, the controller 200 may select one of the first detergent container 1221 and the second detergent container 1222 based on the manipulation signal input by the user via the manipulator 50 disposed on the cabinet 10 or the communication terminal 300 portable by the user in the selection detergent mode M112.

For example, the user may directly select the selected detergent mode M112 and the detergent container 122 to be used via the manipulator 50 or the communication terminal 300. Alternatively, when the user inputs detergent information of the first detergent container 1221 and the second detergent container 1222 and inputs a type or the like of laundry on which the washing process is to be performed, the controller 200 may select the detergent container 122 that matches the situation and execute the selected detergent mode M112.

Additionally, as described above, one embodiment of the present disclosure may execute the detergent request mode M30 described above in the selected detergent mode M112. That is, the controller 200 may execute the detergent request mode M30 of requesting the user to supply the detergent when the remaining amount of detergent in one of the first detergent container 1221 and the second detergent container 1222 is smaller than the reference amount in the selected detergent mode M112.

One embodiment of the present disclosure may execute the detergent request mode M30 in the selected detergent mode M112 to distinguish which one of the first detergent container 1221 and the second detergent container 1222 requires the replenishment of the detergent and notify the user, thereby improving the convenience of use.

Figure 15:
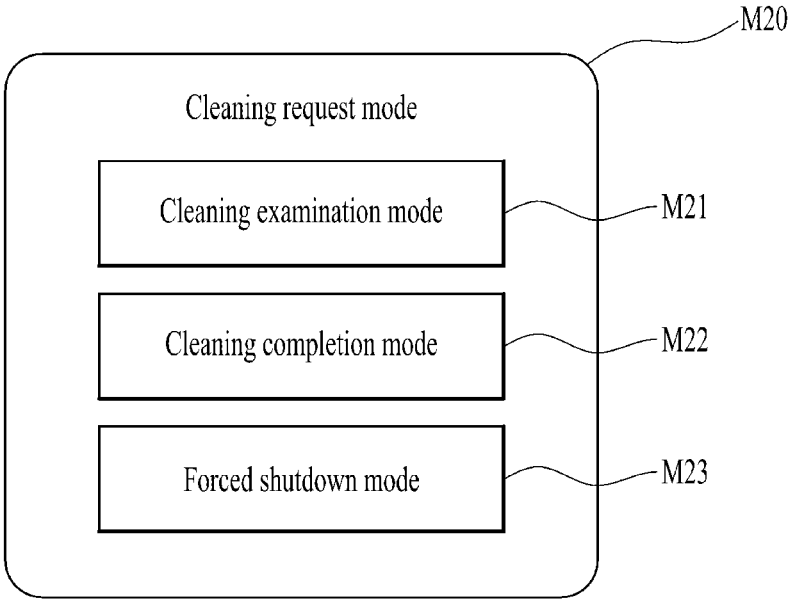
FIG. 15 shows a conceptual diagram showing a cleaning request mode in a laundry treating apparatus according to an embodiment of the present disclosure.

In one example, FIG. 14 shows the single detergent mode M11 and the complex detergent mode M12 that may be selected from the detergent determining mode M10 in one embodiment of the present disclosure, and FIG. 15 shows a conceptual diagram showing the cleaning request mode M20.

Referring to FIGS. 14 and 15, in one embodiment of the present disclosure, the controller 200 may execute the cleaning request mode M20 of requesting the user to clean the first detergent container 1221 or the second detergent container 1222 when a switch between the single detergent mode M11 and the complex detergent mode M12 occurs.

As described above, in the single detergent mode M11, the detergent may be consumed only from one of the first detergent container 1221 and the second detergent container 1222, and in the complex detergent mode M12, the detergent may be consumed together from the first detergent container 1221 and the second detergent container 1222.

In one example, because the detergents in the first detergent container 1221 and the second detergent container 1222 are used together in the complex detergent mode M12, the user may store the different types of detergents in the first detergent container 1221 and the second detergent container 1222 and use the complex detergent mode M12.

For example, the user may use the complex detergent mode M12 in the state in which the laundry detergent is stored in the first detergent container 1221 and the softener is stored in the second detergent container 1222. That is, considering the characteristics of the complex detergent mode M12 in which the first detergent container 1221 and the second detergent container 1222 are used together, a detergent other than the laundry detergent may be stored in one of the first detergent container 1221 and the second detergent container 1222.

On the other hand, in the single detergent mode M11, which includes the sequential detergent mode M111 and the selected detergent mode M112, ultimately the detergent from the one detergent container 122 is used, so that the laundry detergent that is semi-essentially used for the washing process may be stored in the detergent container 122 from which the detergent is used.

In other words, unlike the single detergent mode M11, the complex detergent mode M12 has a possibility that the detergent other than the laundry detergent, for example, the softener is stored in the first detergent container 1221 or the second detergent container 1222 because of the characteristics that the plurality of detergent containers 122 are used, and there is a possibility that the laundry detergent is stored again in the detergent container 122 where the softener was stored when there is a switch from the complex detergent mode M12 to the single detergent mode M11.

Similarly, when switching from the single detergent mode M11 to the complex detergent mode M12, there is a possibility that the detergent other than the laundry detergent, for example, the softener, is stored for the complex detergent mode M12 in the first detergent container 1221 or the second detergent container 1222 where the laundry detergent was stored for the single detergent mode M11.

In other words, unlike the single detergent mode M11 for the efficient use of the laundry detergent, the complex detergent mode M12 that is set to allow the different types of detergents, such as the laundry detergent and the softener, to be used together has a possibility that the different types of detergents are mixed with each other in at least one of the first detergent container 1221 and the second detergent container 1222.

Even after all of the laundry detergent or the softener previously stored in the one detergent container 122 has been consumed, when a different type of detergent is stored in the corresponding detergent container 122, mixing of a residue of the previous detergent and the newly stored detergent may occur.

In one example, when the different types of detergents are mixed with each other, foreign substances may be generated by a chemical reaction between the detergents. For example, when the laundry detergent and the softener are mixed with each other, a gel-type coagulated material may be generated by a mutual reaction therebetween, and the coagulated material may adhere to or be fixed to the detergent pump, the detergent hose 133, the water supply unit 110, and the like and interfere with or block the flow of water and detergent.

Accordingly, in one embodiment of the present disclosure, when there is the switch between the single detergent mode M11 and the complex detergent mode M12 in the detergent determining mode M10, the controller 200 may request the user to perform the cleaning, so that the cleaning request mode M20 in which at least one of the first detergent container 1221 and the second detergent container 1222 is cleaned may be performed.

For example, when the single detergent mode M11 is selected from the detergent determining mode M10 for the previous washing process and the complex detergent mode M12 is selected from the detergent determining mode M10 for the current washing process, or when the complex detergent mode M12 selected from the previous washing process and the single detergent mode M11 is selected from the current washing process, the controller 200 may perform the cleaning request mode M20, and may perform the supply performing mode M40 of supplying the detergent after the cleaning request mode M20 is ended.

In the cleaning request mode M20, the controller 200 may request the user to clean the entire first detergent container 1221 and second detergent container 1222, or may request to clean one of the first detergent container 1221 and the second detergent container 1222.

For example, the user may select the complex detergent mode M12 from the detergent determining mode M10 using the manipulator 50 or the communication terminal 300, and simultaneously, transmit the manipulation signal related to the detergent container 122 to store the detergent other than the laundry detergent, for example, the softener, to the controller 200.

When the change to the single detergent mode M11 occurs from the complex detergent mode M12 in which the detergent container 122 in which the detergent other than the laundry detergent is stored is specified as described above, the controller 200 may execute the cleaning request mode M20 of requesting cleaning of the specified detergent container 122.

In one example, in one embodiment of the present disclosure, the controller 200 may transmit a cleaning request signal to the communication terminal 300 portable by the user in the cleaning request mode M20 to allow the user to clean the first detergent container 1221 or the second detergent container 1222.

As described above, the controller 200 may transmit the notification signal to the notifier 60 or the communication terminal 300, and the notification signal may include the cleaning request signal. That is, the controller 200 may request the user to clean the detergent container 122 by transmitting the cleaning request signal to the notifier 60 or the communication terminal 300.

Specifically, when it is determined that the change between the single detergent mode M11 and the complex detergent mode M12 has occurred in the detergent determining mode M10, the controller 200 may execute the cleaning request mode M20.

In the cleaning request mode M20, the controller 200 may transmit the notification signal, that is, the cleaning request signal, to the notifier 60 or the communication terminal 300, and the notifier 60 or the communication terminal 300 that has received the cleaning request signal may transmit information that the user may perceive, such as the visual information or the auditory information, to the user to request the cleaning.

When determining that the cleaning of the detergent container 122 has been completed in the cleaning request mode M20 or determining that the cleaning request mode M20 must be ended via the manipulation signal by the user, the controller 200 may end the cleaning request mode M20 and continue with the detergent supply mode M1.

In one embodiment of the present disclosure, when the change between the complex detergent mode M12 and the single detergent mode M11 occurs, the controller 200 may execute the cleaning request mode M20, thereby improving maintainability of the detergent container 122, which may be overlooked by the user.

Furthermore, one embodiment of the present disclosure transmits an app push notification of the like to the user via the communication terminal 300 of the user in the cleaning request mode M20, which is advantageous because the user is able to conveniently identify the need for the cleaning of the detergent container 122.

In one example, referring to FIG. 15, in one embodiment of the present disclosure, the controller 200 may notify the user of the need for the cleaning of the detergent container 122 in the cleaning request mode M20, and the cleaning request mode M20 may include a cleaning completion mode M22.

That is, in the cleaning request mode M20, when receiving a cleaning completion signal input by the user via the communication terminal 300 or the manipulator 50 disposed on the cabinet 10, the controller 200 may end the cleaning request mode M20.

As described above, the user who has recognized the need for the cleaning of the detergent container 122 via the notifier 60 or the communication terminal 300 may perform the cleaning of the detergent container 122. When the cleaning of the detergent container 122 is completed, the user may transmit a manipulation signal notifying the completion of the cleaning to the controller 200 via the manipulator 50 or the communication terminal 300.

That is, in one embodiment of the present disclosure, the manipulation signal of the manipulator 50 or the communication terminal 300 may include the cleaning completion signal, and the user may transmit the cleaning completion signal to the controller 200 via the manipulator 50 or the communication terminal 300.

When the cleaning completion signal is received from the manipulator 50 or the communication terminal 300, the controller 200 may determine that the cleaning of the detergent container 122 is complete and enters the cleaning completion mode M22 to continue with the detergent supply mode M1.

That is, in the cleaning completion mode M22, when the cleaning completion signal is received from the user, the controller 200 may end the cleaning request mode M20 and proceed with the detergent supply mode M1 or the supply performing mode M40 described above.

In the detergent supply mode M1, as described above, the user may be requested to replenish the detergent based on the remaining amount of the detergent in the detergent container 122, and in the supply performing mode M40, the washing process may be performed by supplying the detergent to the tub 30 in a detergent supply scheme determined in the detergent determining mode M10.

In one example, in one embodiment of the present disclosure, as described above, the first detergent container 1221 and the second detergent container 1222 may be removable from the detergent feeder 100, and the detergent feeder 100 may further include the detergent container detector 127 that detects whether the first detergent container 1221 and the second detergent container 1222 are mounted.

Additionally, the controller 200 may end the cleaning request mode M20 based on the detection signal of the detergent container detector 127 in the cleaning request mode M20.

That is, in one embodiment of the present disclosure, the controller 200 may execute the cleaning completion mode M22 to end the cleaning request mode M20 based on the detection signal of the detergent container detector 127, in addition to the case in which the user transmits the cleaning completion signal in the cleaning completion mode M22.

Specifically, as described above, the detergent container detector 127 may be disposed on the accommodating casing 130 to detect the pressurization or the contact of the detergent storage unit 120, and accordingly, whether the detergent storage unit 120 is inserted may be detected by the detergent container detector 127.

In the cleaning request mode M20, when the insertion of the detergent storage unit 120 is detected by the detergent container detector 127 or the removal and the insertion of the detergent storage unit 120 are sequentially detected, the controller 200 may execute the cleaning completion mode M22 to end the cleaning request mode M20 and continue with the detergent supply mode M1.

The detergent container detector 127 may be switched to a state of generating the detection signal when the detergent storage unit 120 is inserted, or may generate the detection signal when the detergent storage unit 120 is separated or removed from the detergent feeder 100.

The controller 200 may determine the removal and the insertion of the detergent storage unit 120 based on the detection signal of the detergent container detector 127, and may determine that the cleaning of the detergent container 122 has been performed when the detergent storage unit 120 is inserted or removed and then inserted in the state in which the cleaning request mode M20 has been performed, thereby ending the cleaning request mode M20 via the cleaning completion mode M22.

That is, one embodiment of the present disclosure may end the cleaning request mode M20 when the cleaning completion signal of the user is received in the cleaning completion mode M22 and/or when the detergent storage unit 120 is reinserted after being cleaned via the detection signal of the detergent container detector 127.

In one embodiment of the present disclosure, the controller 200 may identify a cleaning completed state of the detergent container 122 based on the detection signal of the detergent container detector 127, so that the detergent supply mode M1 may be conveniently proceeded even when the user does not separately notify the cleaning of the detergent container 122 via the manipulator 50 or the communication terminal 300.

In one example, in one embodiment of the present disclosure, the cleaning request mode M20 may further include a cleaning examination mode M21. That is, in one embodiment of the present disclosure, in the cleaning request mode M20, the cleaning completion mode M22 may be proceeded excluding the cleaning examination mode M21, the cleaning completion mode M22 or the like may be proceeded after the cleaning examination mode M21.

Specifically, when receiving a cleaning progress signal input by the user via the communication terminal 300 or the manipulator 50 disposed on the cabinet 10 in the cleaning request mode M20, the controller 200 may end the cleaning request mode M20 when a current state is determined to be the cleaning completed state in which the first detergent container 1221 or the second detergent container 1222 has been cleaned.

In other words, in one embodiment of the present disclosure, the cleaning examination mode M21 in which the user determines whether to proceed with the cleaning of the detergent container 122 may be performed in the cleaning request mode M20. In the cleaning examination mode M21, when the cleaning progress signal of the user is received by the controller 200, the cleaning request mode M20 may be ended by the cleaning completion mode M22 when it is determined that the cleaning of the detergent container 122 has been completed.

In one embodiment of the present disclosure, in the complex detergent mode M12, the different types of detergents may be stored in the first detergent container 1221 and the second detergent container 1222, but the user may arbitrarily store the same type of detergent in the first detergent container 1221 and the second detergent container 1222.

In addition, even when the different types of detergents are stored in the first detergent container 1221 and the second detergent container 1222 in the complex detergent mode M12, the single detergent mode M11 may be selected, and the detergent in the first detergent container 1221 or the second detergent container 1222 may be desired to be used as it is.

In other words, depending on an intention to use of the user, there may be cases in which the detergent stored in each of the first detergent container 1221 and the second detergent container 1222 does not change even when there is the switch between the single detergent mode M11 and the complex detergent mode M12. Therefore, in one embodiment of the present disclosure, the controller 200 may determine whether the user is to clean the detergent container 122 via the cleaning examination mode M21 in the cleaning request mode M20.

When the cleaning request mode M20 is performed, the controller 200 may transmit the notification signal to the notifier 60 or the communication terminal 300 via the cleaning examination mode M21 to request the user to determine whether to proceed with the cleaning request mode M20.

For example, the controller 200 may transmit a cleaning examination signal corresponding to the notification signal to the communication terminal 300, and the communication terminal 300 that has received the cleaning examination signal may provide visual information or the like asking the user whether to proceed with the cleaning of the detergent container 122 to the user.

For example, when the cleaning examination signal is received, the communication terminal 300 may provide the user with choices to determine whether to continue with a cleaning progress mode, such as 'yes' and 'no' or 'proceed' and 'ignore'. In other words, the communication terminal 300 may ask the user whether to proceed with the cleaning of the detergent container 122 via a push notification button display or the like.

When determining that the cleaning of the detergent container 122 is necessary by determining the type or the like of detergent currently stored in the detergent container 122, the user may transmit the cleaning progress signal, which is one of the manipulation signals, to the controller 200 via the communication terminal 300 or the manipulator 50. When receiving the cleaning progress signal, the controller 200 may determine whether the cleaning of the detergent container 122 has been completed based on the aforementioned cleaning completion mode M22 and perform the detergent supply mode M1.

In one embodiment of the present disclosure, when receiving the cleaning progress signal, the controller 200 may end the cleaning request mode M20 based on the cleaning completion mode M22 as described above.

That is, when receiving the cleaning progress signal in the cleaning request mode M20, the controller 200 may determine the cleaning completed state based on the cleaning completion signal input by the user via the manipulator 50 or the detection signal of the detergent container detector 127 that senses whether the first detergent container 1221 and the second detergent container 1222 are mounted in the detergent feeder 100.

When receiving the cleaning progress signal via the cleaning examination mode M21, the controller 200 may end the cleaning request mode M20 when the current state is determined to be the cleaning completed state via the cleaning completion mode M22. When the cleaning request mode M20 ends, the detergent request mode M30 or the supply performing mode M40 may proceed.

In one embodiment of the present disclosure, even when the switch between the complex detergent mode M12 and the single detergent mode M11 occurs, whether to proceed with the cleaning of the detergent container 122 is reconfirmed by the user, so that even cases where the cleaning of the detergent container 122 is not necessary may be effectively identified depending on a user's intention.

In one example, in one embodiment of the present disclosure, the controller 200 may end the cleaning request mode M20 when receiving a forced shutdown signal input by the user via the manipulator 50 in the cleaning request mode M20.

Specifically, in one embodiment of the present disclosure, the cleaning request mode M20 may include a forced shutdown mode M23. The forced shutdown mode M23 may be selected by the user in the cleaning examination mode M21.

As described above, in the cleaning examination mode M21, the controller 200 may request the user to determine whether to proceed with the cleaning of the detergent container 122 via the manipulator 50 or the communication terminal 300. In the cleaning examination mode M21, when the user transmits the cleaning progress signal to the controller 200 via the notifier 60 or the communication terminal 300, the controller 200 may end the cleaning request mode M20 based on the cleaning completion mode M22 when it is determined that the cleaning of the detergent container 122 has been completed.

In one example, in the cleaning examination mode M21, when the user transmits the forced shutdown signal, one of the manipulation signals, to the controller 200 via the notifier 60 or the communication terminal 300, the controller 200 may end the cleaning request mode M20 without determining whether the cleaning of the detergent container 122 has been completed, and continue with the detergent supply mode M1.

That is, in one embodiment of the present disclosure, in the cleaning completion mode M22, when receiving the cleaning completion signal of the user or determining that the cleaning of the detergent container 122 is completed via the detection signal of the detergent container detector 127, the controller 200 may end the cleaning request mode M20, but, in the forced termination mode M23, the controller 200 may end the cleaning request mode M20 based on the forced shutdown signal of the user regardless of the cleaning completion signal or the detection signal of the detergent container detector 127.

Figure 16:
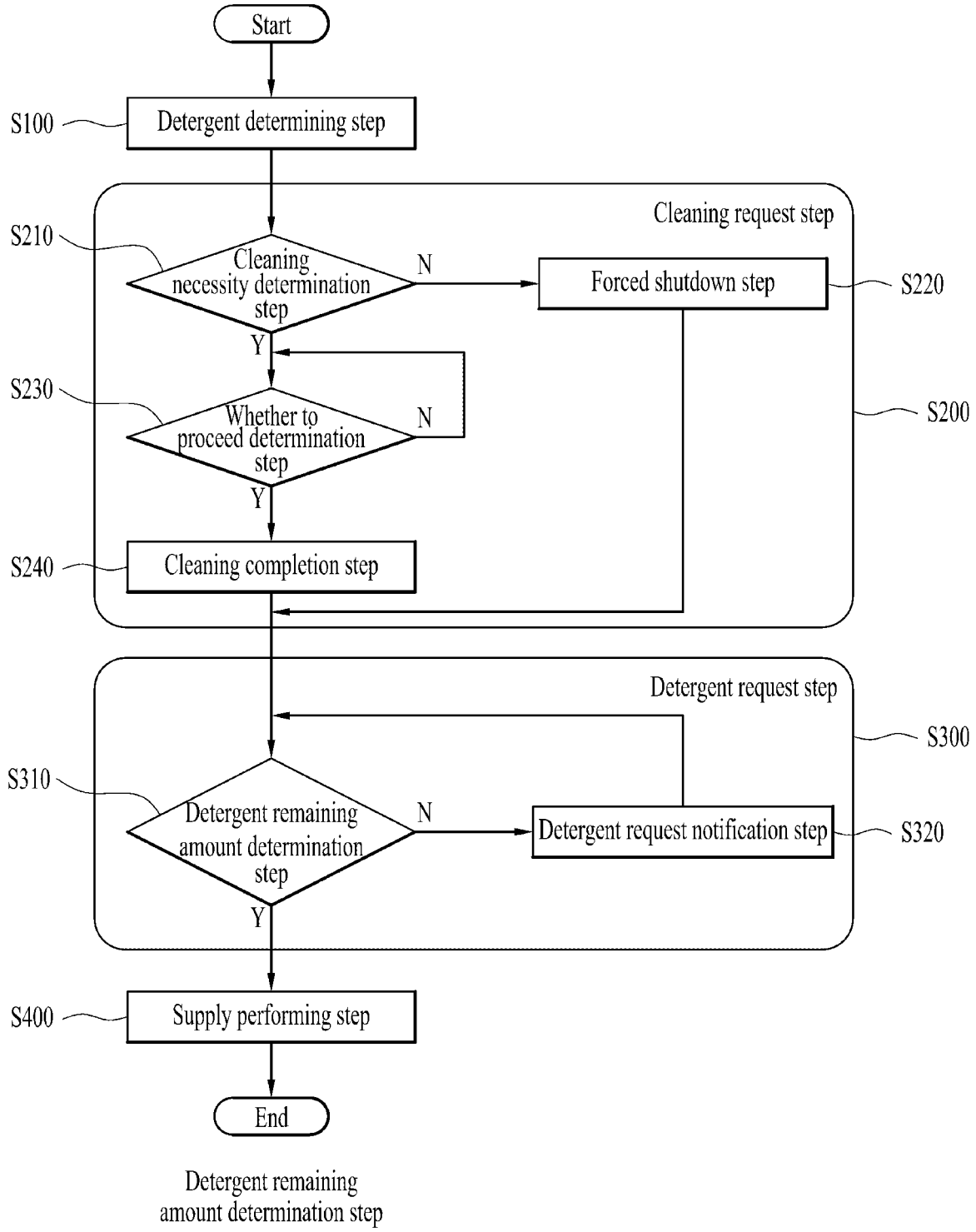
FIG. 16 is a flowchart showing a method for controlling a laundry treating apparatus according to an embodiment of the present disclosure.

In one example, FIG. 16 shows a flowchart of a method for controlling the laundry treating apparatus 1 according to an embodiment of the present disclosure. The control method will be described as follows with reference to FIG. 16. Contents that are redundant with the description of the laundry treating apparatus 1 according to one embodiment of the present disclosure will be summarized or omitted as much as possible.

The method for controlling the laundry treating apparatus 1 according to one embodiment of the present disclosure may include a detergent determining step (S100). In the detergent determining step (S100), the detergent determining mode M10 described above may be performed by the controller 200.

In other words, in the detergent decision step (S100), one of the complex detergent mode M12 and the single detergent mode M11 may be selected by the user's manipulation signal or the determination of the controller 200. In the case of the single detergent mode M11, one of the sequential detergent mode M111 and the selected detergent mode M112 may be selected.

In one example, in one embodiment of the present disclosure, a cleaning request step (S200) and/or a detergent request step (S300) may be performed after the detergent determining step (S100). A sequence of the cleaning request step (S200) and the detergent request step (S300) is irrelevant. Referring to FIG. 16, a case in which the cleaning request step (S200) is performed after the detergent determining step (S100) will be described as follows.

In one embodiment of the present disclosure, the cleaning request step (S200) may be performed after the detergent determining step (S100). In the cleaning request step (S200), the cleaning request mode M20 described above may be executed. In the cleaning request step (S200), the controller 200 may request the user to clean the detergent container 122 via the notification signal.

Specifically, the cleaning request step (S200) may include a cleaning necessity determination step (S210). In the cleaning necessity determination step (S210), the cleaning examination mode M21 described above may be executed. In the cleaning necessity determination step (S210), the controller 200 may transmit the notification signal to the notifier 60 or the communication terminal 300 to ask the user whether to proceed with the cleaning of the detergent container 122.

The cleaning request step (S200) may include a forced shutdown step (S220). In one embodiment of the present disclosure, the aforementioned forced shutdown mode M23 may be executed in the forced shutdown step (S220).

Specifically, in the cleaning necessity determination step (S210), when the user transmits the forced shutdown signal among the manipulation signals to the controller 200 via the manipulator 50 or the communication terminal 300, the controller 200 may end the cleaning request mode M20 based on the forced shutdown mode M23 regardless of the determination on the cleaning completed state of the detergent container 122.

In one example, the cleaning request step (S200) may include a whether to proceed determination step (S230) and a cleaning completion step (S240). In the whether to proceed determination step (S230) and the cleaning completion step (S240), the cleaning completion mode M22 described above may be executed.

Specifically, in the cleaning necessity determination step (S210), when the user transmits the cleaning progress signal as the manipulation signal to the controller 200 via the manipulator 50 or the communication terminal 300, the controller 200 may perform the whether to proceed determination step (S230), and in the whether to proceed determination step (S230), the controller 200 may determine whether the current state is the cleaning completed state.

As described above, the cleaning completed state may correspond to a case in which the cleaning completion signal among the manipulation signals is received from the manipulator 50 or the communication terminal 300 or a case in which the detergent storage unit 120 is removed from and/or inserted into the detergent feeder 100 detected via the detection signal of the detergent container detector 127.

When the controller 200 determines that the current state is the cleaning completed state in the whether to proceed determination step (S230), the cleaning completion step (S240) may be performed. In the cleaning completion step (S240), the controller 200 may end the cleaning request mode M20 and then continue with the detergent supply mode M1.

In addition, in one embodiment of the present disclosure, in the cleaning request step (S200), the cleaning necessity determination step (S210) and the forced shutdown step (S220) may be omitted, and the whether to proceed determination step (S230) and the cleaning completion step (S240) may be performed. Whether to perform the cleaning necessity determination step (S210) and the forced shutdown step (S220) may be determined in terms of control strategy and may be set in advance in the controller 200.

In one example, one embodiment of the present disclosure may further include the detergent request step (S300), and the detergent request step (S300) may be performed after the detergent determining step (S100) or after the cleaning request step (S200). In the detergent request step (S300), the controller 200 may perform the detergent request mode M30 described above.

That is, in the detergent request step (S300), the controller 200 may request the user to replenish the detergent via the notifier 60 or the communication terminal 300 based on the remaining amounts of the detergents in the first detergent container 1221 and/or the second detergent container 1222.

The detergent request step (S300) may include a detergent remaining amount determination step (S310). In the detergent remaining amount determination step (S310), the controller 200 may determine whether the remaining amounts of the detergents in the first detergent container 1221 and/or the second detergent container 1222 are equal to or greater than the reference amount.

Specifically, the controller 200 may request the user to replenish the detergent when each of the remaining amounts of the detergents in the first detergent container 1221 and the second detergent container 1222 is smaller than the reference amount in the sequential detergent mode M111. The controller 200 may request the user to replenish the detergent when the remaining amount of the detergent in the detergent container 122 selected for the detergent use among the first detergent container 1221 and the second detergent container 1222 is smaller than the reference amount in the selected detergent mode M112. Further, the controller 200 may request the user to replenish the detergent when each of the remaining amounts of the detergents in the first detergent container 1221 and the second detergent container 1222 is smaller than the reference amount in the complex detergent mode M12.

That is, in the detergent remaining amount determination step (S310), the controller 200 may determine whether the remaining amounts of the detergents in the first detergent container 1221 and the second detergent container 1222 are both smaller than the reference amount when the detergent supply scheme determined in the detergent determining step is the sequential detergent mode M111, determine whether the remaining amount of the detergent in the detergent container 122 selected for the detergent use among the first detergent container 1221 and the second detergent container 1222 is smaller than the reference amount when the detergent supply scheme determined in the detergent determining step is the selected detergent mode M112, and determine whether the remaining amounts of the detergents in the first detergent container 1221 and the second detergent container 1222 are both smaller than the reference amount when the detergent supply scheme determined in the detergent determining step is the complex detergent mode M12.

When it is determined in the detergent remaining amount determination step (S310) that the remaining amounts of the detergents in the first detergent container 1221 and the second detergent container 1222 are not equal to or greater than the reference amount, that is, the remaining amounts of the detergents are determined to be smaller than the reference amount, the controller 200 may perform a detergent request notification step (S320).

In the detergent request notification step (S320), the controller 200 may request the user to replenish the detergent via the notifier 60 or the communication terminal 300. In the detergent request notification step (S320), the controller 200 may transmit the detergent request signal among the notification signals to the notifier 60 or the communication terminal 300, and the notifier 60 or the communication terminal 300 that has received the detergent request signal may request the user to replenish the detergent via the visual information or the auditory information.

When the controller 200 determines that the detergent remaining amount is equal to or greater than the reference amount in the detergent remaining amount determination step (S310), the controller 200 may end the detergent request mode M30 and perform a supply performing step (S400). In the supply performing step (S400), the controller 200 may execute the supply performing mode M40 described above.

That is, in the supply performing step (S400), the controller 200 may control the detergent feeder 100 to supply the detergent into the tub 30 based on the detergent supply scheme determined in the detergent determining step (S100), for example, one of the sequential detergent mode M111, the selected detergent mode M112, and the complex detergent mode M12.

Although the present disclosure has been shown and described in relation to a specific embodiment, it will be apparent to those of ordinary skill in the art that the present disclosure may be improved and changed in various ways without departing from the technical spirit of the present disclosure provided by the claims below.

What is claimed is:

1. A laundry treating apparatus comprising:

a cabinet;

a tub disposed inside the cabinet and configured to receive water therein;

a drum rotatably disposed inside the tub and configured to receive laundry therein;

a detergent feeder connected to the tub and including a first detergent container and a second detergent container each configured to receive a detergent; and a controller configured to control the detergent feeder to selectively perform one of a single detergent mode or a complex detergent mode, wherein controlling the detergent feeder comprises:

based on the single detergent mode being performed, controlling the detergent feeder to supply the detergent to the tub from one of the first detergent container or the second detergent container, and based on the complex detergent mode being performed, controlling the detergent feeder to supply the detergents to the tub from the first detergent container and the second detergent container, and wherein the controller is further configured to, based on (i) types of the detergents stored in the first detergent container and the second detergent container being different from each other and (ii) switching between the single detergent mode and the complex detergent mode being performed, perform a cleaning request mode to request cleaning of at least one of the first detergent container or the second detergent container.

2. The laundry treating apparatus of claim 1, wherein the controller is configured to select one of the single detergent mode or the complex detergent mode based on a manipulation signal received from a manipulator disposed on the cabinet or a communication terminal.

3. The laundry treating apparatus of claim 1, wherein the single detergent mode includes a sequential detergent mode, and wherein the controller is configured to, based on the sequential detergent mode being performed, control the detergent feeder to supply (i) the detergent in the first detergent container to the tub when a remaining amount of the detergent in the first detergent container is equal to or greater than a reference amount and (ii) supply the detergent in the second detergent container to the tub when the remaining amount of the detergent in the first detergent container is less than the reference amount.

4. The laundry treating apparatus of claim 3, wherein the detergent feeder includes a remaining amount detector configured to detect a remaining amount of the detergent in each of the first detergent container and the second detergent container, and wherein the controller is configured to determine whether the remaining amount of the detergent in the first detergent container is equal to or greater than the reference amount based on a remaining amount detection signal from the remaining amount detector.

5. The laundry treating apparatus of claim 3, wherein the controller is configured to, based on a remaining amount of the detergent in each of the first detergent container and the second detergent container being less than the reference amount while the sequential detergent mode is performed, perform a detergent request mode to thereby request additional supply of detergents.

6. The laundry treating apparatus of claim 5, wherein requesting the additional supply of the detergents comprises providing visual information or auditory information via a notifier disposed on the cabinet or a communication terminal.

7. The laundry treating apparatus of claim 3, wherein the single detergent mode further includes a selected detergent mode, and wherein the controller is configured to, based on the selected detergent mode being performed, control the detergent feeder to supply the detergent to the tub from one of the first detergent container or the second detergent container.

8. The laundry treating apparatus of claim 7, wherein the controller is configured to select one of the sequential detergent mode or the selected detergent mode based on a manipulation signal received from a manipulator disposed on the cabinet or a communication terminal.

9. The laundry treating apparatus of claim 7, wherein the controller is configured to, while the selected detergent mode is performed, select one of the first detergent container or the second detergent container to supply the detergent to the tub based on a manipulation signal received from a manipulator disposed on the cabinet or a communication terminal.

10. The laundry treating apparatus of claim 7, wherein the controller is configured to, based on the selected detergent mode being performed and a remaining amount of the detergent in one of the first detergent container or the second detergent container being less than the reference amount, perform a detergent request mode to thereby request additional supply of detergents.

11. The laundry treating apparatus of claim 1, wherein requesting the cleaning comprises transmitting a cleaning request signal to a communication terminal.

12. The laundry treating apparatus of claim 11, wherein the controller is configured to, based on a cleaning completion signal input from the communication terminal or a manipulator disposed on the cabinet being received while the cleaning request mode is performed, stop performing the cleaning request mode.

13. The laundry treating apparatus of claim 11, wherein the first detergent container and the second detergent container are detachably coupled to the detergent feeder, wherein the detergent feeder further includes a detergent container detector configured to detect whether at least one of the first detergent container or the second detergent container is coupled to the detergent feeder, and wherein the controller is configured to, while the cleaning request mode is performed, stop performing the cleaning request mode based on a detection signal of the detergent container detector.

14. The laundry treating apparatus of claim 11, wherein the controller is configured to, based on the cleaning request mode being performed and a cleaning progress signal from the communication terminal or a manipulator disposed on the cabinet being received, stop performing the cleaning request mode according to a determination that a current operation state of the laundry treating apparatus is a cleaning completed state in which the first detergent container or the second detergent container is cleaned.

15. The laundry treating apparatus of claim 14, wherein the controller is configured to, based on the cleaning progress signal being received while the cleaning request mode is performed, determine the cleaning completed state according to a cleaning completion signal received from the manipulator or a detection signal of a detergent container detector, the detergent container detector being configured to detect whether at least one of the first detergent container or the second detergent container is coupled to the detergent feeder.

16. The laundry treating apparatus of claim 14, wherein the controller is configured to, based on a forced shutdown signal being received from the manipulator while the cleaning request mode is performed, stop performing the cleaning request mode.

* * * * *